US011672304B2

(12) United States Patent
Sakamoto et al.

(10) Patent No.: US 11,672,304 B2
(45) Date of Patent: Jun. 13, 2023

(54) SHOE SOLE, AND SHOE INCLUDING SHOE SOLE

(71) Applicant: ASICS CORPORATION, Kobe (JP)

(72) Inventors: Masanori Sakamoto, Kobe (JP); Kenta Moriyasu, Kobe (JP); Ayu Bessho, Kobe (JP); Takayuki Ueda, Kobe (JP); Kenta Nakaya, Kobe (JP); Masaki Nakahara, Kobe (JP)

(73) Assignee: ASICS CORPORATION, Kobe (JP)

( * ) Notice: Subject to any disclaimer, the term of this patent is extended or adjusted under 35 U.S.C. 154(b) by 0 days.

(21) Appl. No.: 17/440,140

(22) PCT Filed: Mar. 18, 2019

(86) PCT No.: PCT/JP2019/011262
§ 371 (c)(1),
(2) Date: Sep. 16, 2021

(87) PCT Pub. No.: WO2020/188715
PCT Pub. Date: Sep. 24, 2020

(65) Prior Publication Data
US 2022/0087359 A1 Mar. 24, 2022

(51) Int. Cl.
*A43B 7/08* (2022.01)
*A43B 13/14* (2006.01)

(52) U.S. Cl.
CPC ..... *A43B 7/088* (2013.01); *A43B 7/087* (2013.01); *A43B 13/14* (2013.01)

(58) Field of Classification Search
CPC ..... A43B 7/081; A43B 7/082; A43B 7/087; A43B 7/088
See application file for complete search history.

(56) References Cited

U.S. PATENT DOCUMENTS 4,000,566 A * 1/1977 Famolare, Jr. ..... A43B 5/00 36/28
4,078,321 A 3/1978 Famolare, Jr.
4,377,042 A * 3/1983 Bauer ..... A43B 13/36 36/15
4,438,573 A * 3/1984 McBarron ..... A43B 13/181 36/29

(Continued)

FOREIGN PATENT DOCUMENTS

CN 1864576 A 11/2006
CN 108720168 A 11/2018

(Continued)

OTHER PUBLICATIONS

Office Action issued in JP 2019-544750; mailed by the Japanese Patent Office dated Sep. 27, 2019.

(Continued)

*Primary Examiner* — Jila M Mohandesi
(74) *Attorney, Agent, or Firm* — Studebaker & Brackett PC

(57) ABSTRACT

Provided is a shoe sole, wherein ventilation grooves recessed in the thickness direction of the shoe sole are formed in the upper surface part, the shoe sole has a forefoot portion that has an air intake port formed in at least one of a medial side wall and a lateral side wall in the side wall part to be in communication with the ventilation grooves and draw air from outside into the ventilation grooves, the shoe sole has a midfoot portion that has an air outlet port formed in at least one of the medial side wall and the lateral side wall to be in communication with the air intake port through the ventilation grooves and discharge air in the ventilation groove to the outside, and at least a part of the ventilation grooves constitutes an air intake groove extending obliquely rearward from the air intake port.

16 Claims, 20 Drawing Sheets

(56) References Cited

U.S. PATENT DOCUMENTS

| | | | | | |
|---|---|---|---|---|---|
| 4,617,745 | A * | 10/1986 | Batra | A43B 7/146 | 36/43 |
| 4,654,982 | A * | 4/1987 | Lee | A43B 13/203 | 36/3 R |
| 4,813,160 | A * | 3/1989 | Kuznetz | A43B 7/088 | 36/3 R |
| 4,837,948 | A * | 6/1989 | Cho | A43B 7/082 | 36/3 R |
| 5,400,526 | A * | 3/1995 | Sessa | A43B 7/081 | 36/3 R |
| 5,921,003 | A * | 7/1999 | Kim | A43B 1/0045 | 36/136 |
| 7,168,190 | B1 * | 1/2007 | Gillespie | A43B 3/24 | 363/31 |
| 7,607,241 | B2 * | 10/2009 | McDonald | A43B 3/0057 | 36/102 |
| 7,946,058 | B2 * | 5/2011 | Johnson | A43B 13/125 | 36/31 |
| 8,650,776 | B2 * | 2/2014 | Hazenberg | A43B 13/141 | 36/102 |
| 8,959,802 | B2 * | 2/2015 | Hatfield | A43B 3/0057 | 36/97 |
| 2007/0028483 | A1 | 2/2007 | Miyata | | |
| 2007/0283593 | A1 | 12/2007 | Malenotti | | |
| 2009/0293314 | A1 * | 12/2009 | Dekovic | A43B 13/14 | 36/103 |
| 2013/0232826 | A1 * | 9/2013 | Bier | A43B 7/08 | 12/142 V |
| 2018/0295935 | A1 | 10/2018 | Giandolini et al. | | |

FOREIGN PATENT DOCUMENTS

| | | | |
|---|---|---|---|
| EP | 1 358 811 | A1 | 11/2003 |
| EP | 2 286 685 | A1 | 2/2011 |
| JP | 2007-134563 | A | 5/2007 |
| KR | 2001-0088977 | A | 9/2001 |
| WO | 2014/101355 | A1 | 7/2014 |

OTHER PUBLICATIONS

International Search Report issued in PCT/JP2019/011262; dated Jun. 4, 2019.

Notification of Transmittal of Translation of the International Preliminary Report on Patentability and Translation of Written Opinion of the International Searching Authority; PCT/JP2019/011262; dated Sep. 30, 2021.

The partial supplementary European search report (R. 164 EPC) issued by the European Patent Office dated Feb. 18, 2022, which corresponds to European Patent Application No. 19920127.8 and is related to U.S. Appl. No. 17/440,140.

An Office Action mailed by China National Intellectual Property Administration dated Feb. 21, 2022, which corresponds to Chinese Patent Application No. 201980094316.2 and is related to U.S. Appl. No. 17/440,140; with English language translation.

The extended European search report issued by the European Patent Office dated Apr. 28, 2022, which corresponds to European Patent Application No. 19920127.8 and is related to U.S. Appl. No. 17/440,140.

An Office Action mailed by China National Intellectual Property Administration dated Aug. 22, 2022, which corresponds to Chinese Patent Application No. 201980094316.2 has received an Office Action and is related to U.S. Appl. No. 17/440,140; with English language translation.

Communication pursuant to Article 94(3) EPC issued by the European Patent Office dated Feb. 10, 2023, which corresponds to European Patent Application No. 19920127.8-1015 and is related to U.S. Appl. No. 17/440,140.

* cited by examiner

SHOE SOLE, AND SHOE INCLUDING SHOE SOLE

FIELD

The present invention relates to a shoe sole having a ventilation structure for ensuring breathability, and a shoe including the shoe sole.

BACKGROUND

Generally, wearing a shoe for a long time or wearing a shoe and performing a vigorous exercise such as running causes increase in temperature and humidity inside the shoe due to sweat generated on the foot of a wearer. Increase in temperature and humidity inside the shoe in this manner causes not only a problem of impairing the comfort of the wearer but also a problem of easily causing blisters on the foot of the wearer. Because of this, there is a strong demand for enhanced breathability for shoes, particularly for shoes worn by runners, in order to suppress the increase in temperature and humidity inside the shoes when worn.

As a conventionally known measure for increasing the breathability inside a shoe, forming a ventilation structure in a shoe sole is known. Such a ventilation structure includes, for example, a structure in which air is drawn into a shoe sole and the air drawn therein is drawn out from the shoe sole.

For example, Patent Literature 1 discloses a shoe sole for footwear, particularly for those used in motorcycling, which is provided with a ventilation system induced by a Venturi effect. The shoe sole has an air passage including inlet openings located at a side surface on the front side of the footwear and outlet openings located at a side surface on the rear side of the footwear.

In the shoe sole disclosed in Patent Literature 1, two inlet openings and two outlet openings are provided in mirror symmetry on the medial side and lateral side of the footwear, respectively. In this shoe sole, a part of a strong air flow generated along the front part and the front end of the footwear is drawn into the inside of the inlet openings 10. The drawn air flows through the air passages to the outlet openings while performing a desired venting action with the inside of the shoe. The shoe sole of Patent Literature 1 thus ensures breathability in the shoe by means of such a ventilation system.

However, the shoe sole of Patent Literature 1 is supposed to be used in such a special environment that a wearer is straddling a motorcycle. When the wearer is straddling the motorcycle, less air flows through the medial side of the foot of the wearer. On the other hand, there is usually no object between the right foot and the left foot in a general using state of the shoe, such as the state where the wearer is at rest, walking or running, an air flow around the shoe is greatly different from that in the state where the wearer is straddling the motorcycle. Since the aforementioned ventilation system used in the shoe sole of Patent Literature 1, which is designed exclusively for ensuring ventilation in such a special environment, has a problem that the breathability inside the shoe cannot be effectively enhanced in a general using state of the shoe such as the state where the wearer is at rest, walking, or running.

There is a constant demand for a shoe sole capable of enhancing the breathability inside the shoe and a shoe with enhanced breathability in a general using state of the shoe, for example, the state where the wearer is at rest, walking, or running.

CITATION LIST

Patent Literature

Patent Literature 1: JP 2007-307387 A

SUMMARY

Technical Problem

Therefore, it is an object of the present invention to provide a shoe sole capable of enhancing the breathability inside a shoe, in particular a shoe sole capable of further enhancing the breathability inside a shoe when a wearer is walking or running, and/or a shoe with enhanced breathability inside the shoe.

Solution to Problem

The present inventors have found that the aforementioned problem can be solved and hence accomplished the present invention, based on the finding that the wind speed in the vicinity of the forefoot portion of the shoe is slowed down by collision of air with the forefoot portion of the shoe during, for example, walking or running of the wearer so that a positive air pressure is generated, and the finding that the wind from the front side of the shoe passes through the shoe surface without being slow down on the medial side of the midfoot portion of the shoe so that a negative air pressure is generated.

According to a first form of the shoe sole according to the present invention, the shoe sole including: an upper surface part configured to enable an upper member to be provided thereover; a bottom surface part configured to be in contact with the ground; and a side wall part configured to connect an outer peripheral end of the upper surface part and an outer peripheral end of the bottom surface part in a thickness direction of the shoe sole, wherein ventilation grooves recessed in the thickness direction of the shoe sole from an upper side are formed in the upper surface part, the shoe sole has a forefoot portion that has an air intake port formed in at least one of a medial side wall on a medial side in the side wall part and a lateral side wall on a lateral side in the side wall part to be in communication with the ventilation grooves and draw air from outside into the ventilation grooves, the shoe sole has a midfoot portion that has an air outlet port formed in at least one of the medial side wall and the lateral side wall to be in communication with the air intake port through the ventilation grooves and discharge air in the ventilation groove to the outside, and at least a part of the ventilation grooves constitutes an air intake groove extending obliquely rearward from the air intake port.

Preferably, the air intake port is formed in the lateral side wall, and the air intake groove extends obliquely rearward from the lateral side of the shoe sole to the medial side.

Preferably, the air intake port has a shape that spreads in a tapered shape toward the outside.

Preferably, the air intake port is formed in each of the medial side wall and the lateral side wall, each of the air intake port formed in the medial side wall and the air intake port formed in the lateral side wall has a recessed shape opening upward, and the air intake groove connects the air intake port having a recessed shape and formed in the medial side wall to the air intake port having a recessed shape and formed in the lateral side wall.

Preferably, a bending groove recessed from the lower side in the thickness direction of the shoe sole is formed in the bottom surface part at a position facing the air intake groove formed in the upper surface part in the thickness direction of the shoe sole, and the bending groove extends from the lateral side wall to the medial side wall. More preferably, a deepest line passing through the bending groove is formed to be displaced rearward from a deepest line passing through the air intake groove.

Preferably, the ventilation grooves each are formed to have a depth recessed in the thickness direction of the shoe sole gradually increasing as it advances from the front side of the forefoot portion toward the rear side of the midfoot portion.

According to a second form of the shoe sole according to the present invention, the shoe sole including: an upper surface part configured to enable an upper member to be provided thereover; a bottom surface part configured to be in contact with the ground; and a side wall part configured to connect an outer peripheral end of the upper surface part and an outer peripheral end of the bottom surface part in a thickness direction of the shoe sole, wherein ventilation grooves recessed in the thickness direction of the shoe sole are formed in the upper surface part, the shoe sole has a forefoot portion that has an air intake port formed in the side wall part to be in communication with the ventilation grooves and draw air from outside into the ventilation grooves, the shoe sole has a midfoot portion that has an air outlet port formed in at least one of the medial side wall on the medial side of the side wall part and the lateral side wall on the lateral side of the side wall part to be in communication with the air intake port through the ventilation grooves and discharge air in the ventilation grooves to the outside, and a total opening area of the air outlet port is larger than a total opening area of the air intake port.

Preferably, the air outlet port includes at least one medial side air outlet port formed in the medial side wall and at least one lateral side air outlet port formed in the lateral side, and a total opening area of the medial side outlet port is larger than a total opening area of the lateral side air outlet port.

Preferably, the at least one medial side air outlet port is formed in an area between a first innermost point which is an innermost point in the forefoot portion of the shoe sole and a second innermost point which is an innermost point in the rearfoot portion of the shoe sole.

Preferably, a total opening area of ends of the ventilation grooves opening on the medial side of the midfoot portion of the upper surface part is smaller than a total opening area of ends of the ventilation grooves opening on the lateral side of the midfoot portion of the upper surface part.

Preferably, a part of the shoe sole is configured to be located on any straight line connecting an arbitrary point within the medial side air outlet port and an arbitrary point within the lateral side air outlet port.

Preferably, a reinforcing member that suppresses distortion of an area around the medial side air outlet port is provided in at least a part of the area around the medial side air outlet port in the medial side wall.

Preferably, the ventilation grooves each are formed to have a depth recessed in the thickness direction of the shoe sole gradually increasing as it advances from the front side of the forefoot portion toward the rear side of the midfoot portion.

According to a third form of the shoe sole according to the present invention, the shoe sole including: an upper surface part configured to enable an upper member to be provided thereover; a bottom surface part configured to be in contact with the ground; and a side wall part configured to connect an outer peripheral end of the upper surface part and an outer peripheral end of the bottom surface part in a thickness direction, wherein ventilation grooves recessed in the thickness direction of the shoe sole are formed in the upper surface part, the shoe sole has a forefoot portion that has an air intake port formed in a lateral side wall on a lateral side of the side wall part to be in communication with the ventilation groove and draw air from outside into the ventilation grooves, an air outlet port is formed in an area between a first innermost point which is an innermost point in the forefoot portion of the shoe sole, and a second innermost point which is an innermost point in a rearfoot portion of the shoe sole, in a medial side wall on a medial side of the side wall part, to be in communication with the air intake port and discharge air in the ventilation grooves to the outside, and at least a part of the ventilation grooves constitutes an air intake groove extending obliquely rearward from the air intake port toward the medial side.

The shoe according to the present invention includes the shoe sole according to any one of the first form to the third form, wherein an inner sole, in which a plurality of small vent holes in communication with the ventilation grooves are formed, is mounted on the upper side of the shoe sole.

Preferably, the plurality of small vent holes are formed in an area other than an area corresponding to the metatarsophalangeal joint.

Preferably, the forefoot portion of the inner sole is provided with a cutout at an area corresponding to the air intake port.

DESCRIPTION OF EMBODIMENTS

Figure 1:
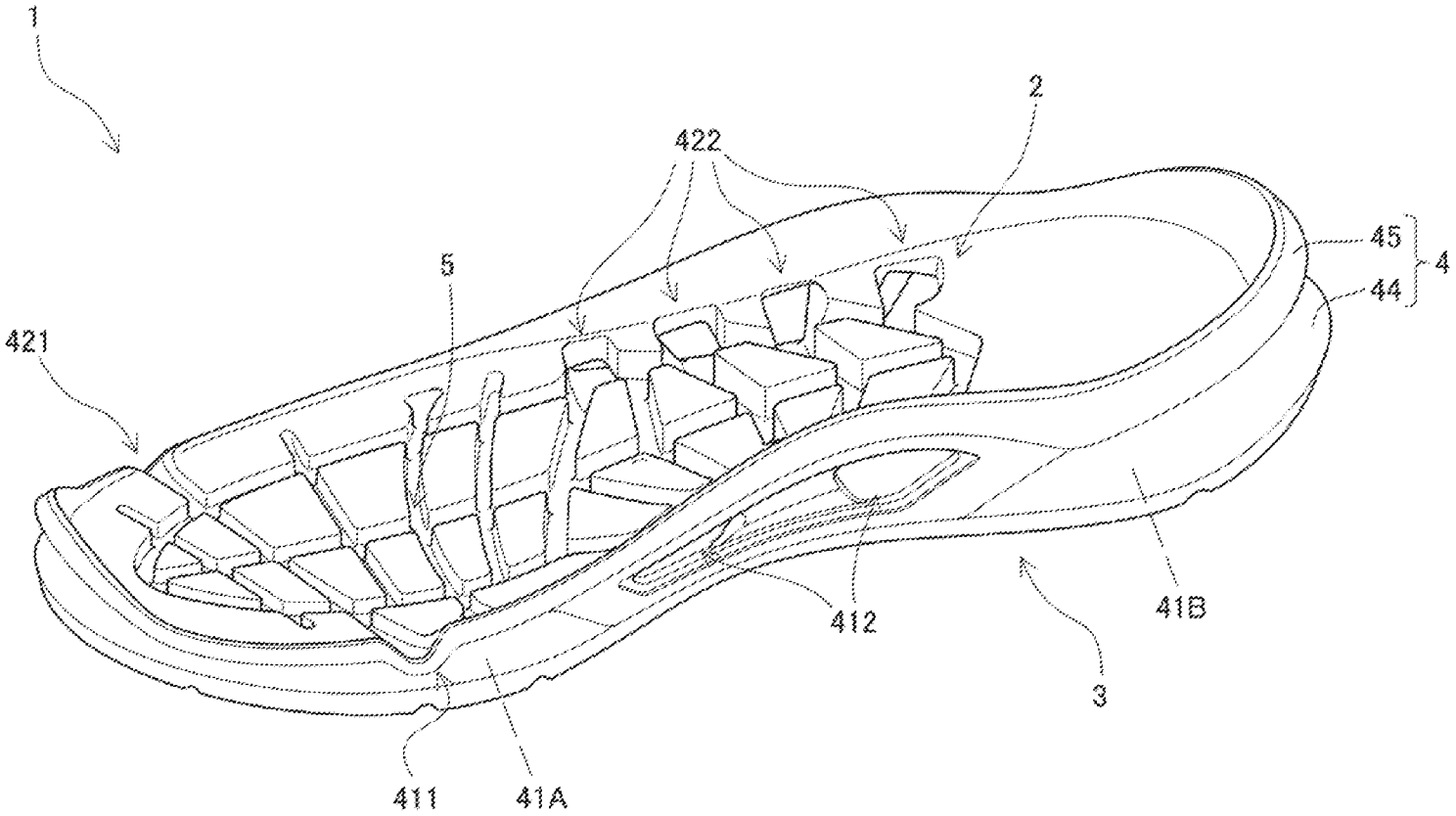
FIG. 1 is a perspective view showing a shoe sole according to one embodiment of the present invention.

Hereinafter, a shoe sole and a shoe according to an embodiment of the present invention will be described. The following embodiments are merely shown as examples. The present invention is not limited to the following embodiments at all.

In the drawings referred to in the embodiments and the like, members or parts having substantially the same function will be referred to by the same reference sign. The drawings referred in the embodiments are schematically described, and the ratio of the dimensions of the objects drawn in the drawing, etc. may be different from the ratio of the dimensions of the actual objects, etc.

Figure 2:
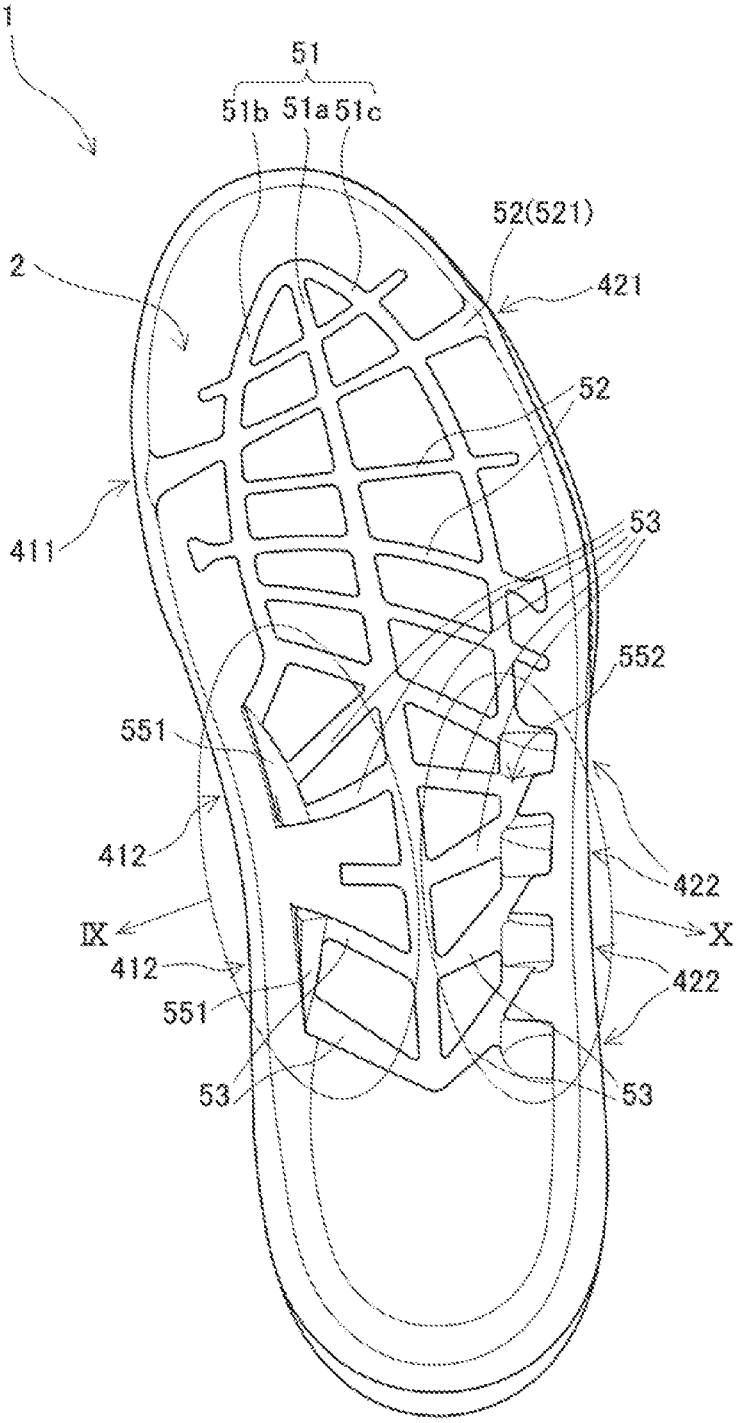
FIG. 2 is a top view showing the shoe sole of FIG. 1.

In this embodiment, the description will be given by taking the toe side in the length direction of the shoe sole as forward, the heel side in the length direction of the shoe sole as rearward, and the straight line in the length direction passing through the toe-side end and the heel-side end of the shoe sole as the center line. When the toe-side end of the shoe sole is referred to as a 0% position and the heel-side end is referred to as a 100% position, an area in the range of the 0% position to a 40% position in the length direction of the shoe sole (which includes the position passing through the 40% position on the center line of the shoe sole and lying on a 40% position of the straight line in the width direction orthogonal to the center line. The same applies hereinafter) is referred to as the forefoot portion, an area in the range of the 40% position to a 80% position is referred to as the midfoot portion, and an area in the range of the 80% position to the 100% position is referred to as the rearfoot portion. These areas herein are designated respectively by areas when the upper surface of the shoe sole is viewed from the front as shown in FIG. 2.

In this embodiment, a medial side of the shoe sole means the side corresponding to the medial side (the side close to the median) of the sole of the foot in the anatomical position, and a lateral side of the shoe sole means the side corresponding to the lateral side (the side far from the median) of the sole of the foot in the anatomical position, unless otherwise specified.

In this embodiment, the thickness direction means the thickness direction of the shoe sole, unless otherwise specified. In this embodiment, the depth of the groove or the recess formed in the shoe sole means the depth recessed in the thickness direction from the upper surface or the bottom surface of the shoe sole. In this embodiment, the deepest line of a groove means a line connecting the deepest parts in the thickness direction of the lateral wall (in the case where the deepest parts have a constant width, the center thereof) in the length direction of the groove.

In this embodiment, among the openings formed in the shoe sole, an opening area of an opening such as a groove end opening upward may be mentioned. The opening area of such an opening is referred to an opening area defined in the state where, on the assumption that the insole is mounted on the shoe sole (specifically, on the upper surface part of the shoe sole at a height of a surface at which no groove is formed), the upper side of the opening is closed.

As shown in FIG. 1 to FIG. 5, the shoe sole 1 of this embodiment includes an upper surface part 2 configured to enable an upper member to be provided thereover, a bottom surface part 3 configured to be in contact with the ground, and a side wall part 4 configured to connect an outer peripheral end of the upper surface part 2 and the outer peripheral end of the bottom surface part 3 in the thickness direction of the shoe sole 1. The bottom surface part 3 faces the upper surface part 2 in the thickness direction of the shoe sole 1. In this embodiment, the side wall part 4 is constituted by a wall 44 facing in the thickness direction of the shoe sole 1 and an extension 45 extending upward throughout the entire wall 44.

A ventilation groove 5 recessed in the thickness direction of the shoe sole 1 is formed in the upper surface part 2. The forefoot portion of the shoe sole 1 has a medial side air intake port 411 and a lateral side air intake port 421 formed respectively in a medial side wall 41 and a lateral side wall 42 to be in communication with the ventilation groove 5 and draw air from outside into the ventilation groove 5. The midfoot portion of the shoe sole 1 has a medial side air outlet port 412 and a lateral side air outlet port 422 formed respectively in the medial side wall 41 and the lateral side wall 42 to be respectively in communication with the medial side air intake port 411 and the lateral side air intake port 421 through the ventilation groove 5 and draw air from the ventilation groove 5 to the outside. With such a configuration, the ventilation groove 5 serves as a passage for allowing air to pass through the inside of the shoe sole 1 until the air drawn in from the outside through the air intake port is drawn out to the outside through the air outlet port. In this embodiment, the medial side air outlet ports 412 are formed in an area between a first innermost point 41A, which is the innermost point in the forefoot portion of the shoe sole 1, and a second innermost point 41B, which is the innermost point in the rearfoot portion of the shoe sole 1.

Figure 8:
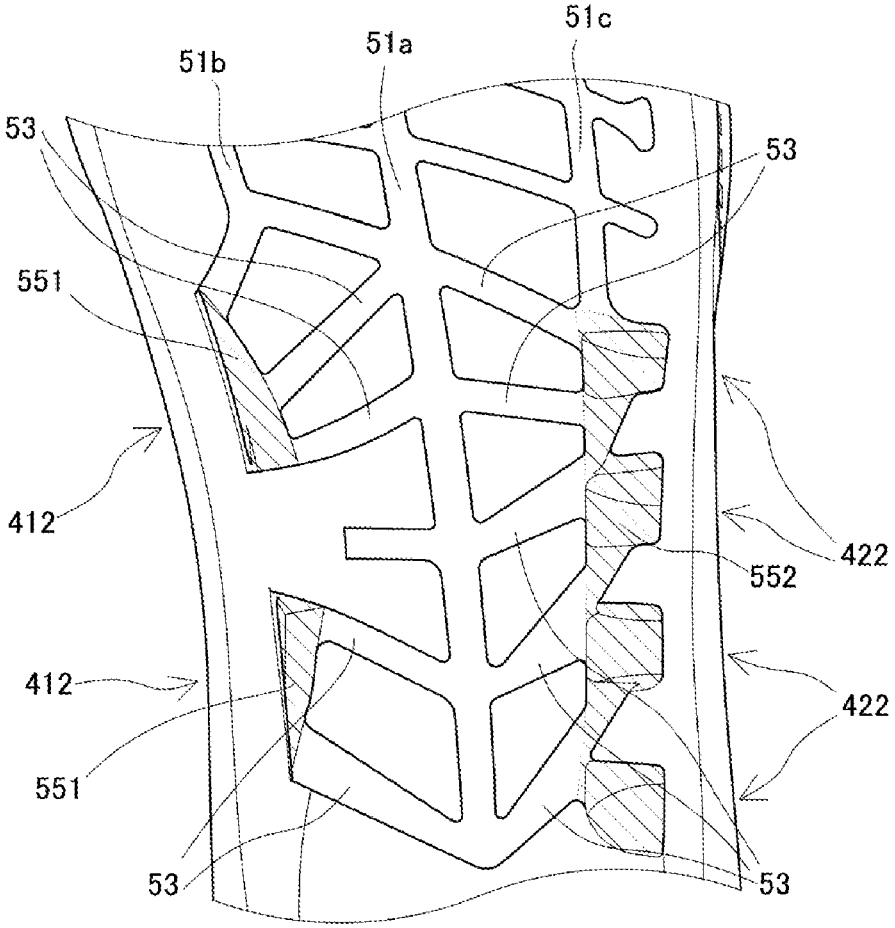
FIG. 8 is an enlarged top view showing a midfoot portion of the shoe sole of FIG. 1.

Further, in this embodiment, medial side air outlet spaces 551 and a lateral side air outlet space 552, which are respectively connected to the medial side air outlet ports 412 and the lateral side air outlet ports 422 at the medial side end and the lateral side end of the midfoot portion, are formed in the upper surface part 2, as shown in more detail in the enlarged view of the midfoot portion in FIG. 8. The upper surface part 2 in the area of forming these spaces is recessed to a depth equal to or larger than the ventilation groove 5. The ventilation groove 5 connects the medial side air outlet spaces 551 and the lateral side air outlet space 552 to each other and allows the medial side air outlet ports 412 and the lateral side air outlet ports 422 to be in communication with each other via the medial side air outlet spaces 551 and the lateral side air outlet space 552 respectively.

In this embodiment, the ventilation groove 5 is formed in a wide area of the upper surface part 2 from the forefoot portion to the midfoot portion, as shown in FIG. 2. Specifically, the ventilation groove 5 includes a central longitudinal ventilation groove 51*a* extending in the length direction from the forefoot portion to the vicinity of the boundary between the midfoot portion and the rearfoot portion through the vicinity of the center in the width direction of the shoe sole 1, a medial side longitudinal ventilation groove 51*b* and a lateral side longitudinal ventilation groove 51*c* extending in the forefoot portion to form a parabolic shape from the front end on the forefoot side of the longitudinal ventilation groove 51 rearward respectively on the medial side and the lateral side and then extending to the middle of the midfoot portion in the length direction, a plurality of transverse ventilation grooves 52 each extending in the width direction or the oblique direction in the forefoot portion and/or the midfoot portion and configured to cross the longitudinal ventilation grooves 51*a* to 51*c* to respectively allow the longitudinal ventilation grooves 51*a* to 51*c* to be in communication with each other, and a plurality of air outlet guide grooves 53 configured to connect the central longitudinal ventilation groove 51*a* to the medial side air outlet spaces 551 and the lateral side air outlet space 552 in the midfoot portion. Midfoot-side ends of the medial side longitudinal ventilation groove 51*b* and the lateral side longitudinal ventilation groove 51*c* are also connected to the medial side air outlet spaces 551 and the lateral side air outlet space 552, respectively.

Figure 7:
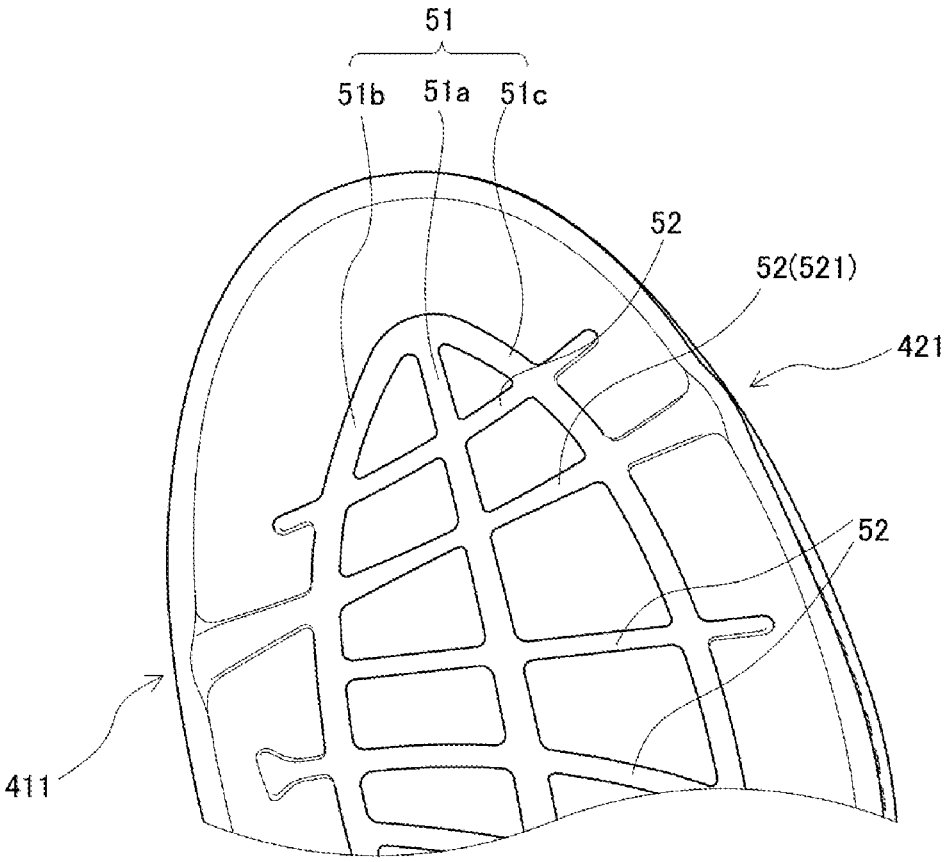
FIG. 7 is an enlarged top view showing a forefoot portion of the shoe sole of FIG. 1.

In particular, as shown in FIG. 7 in detail, one of the transverse ventilation grooves 52 in the forefoot portion constitutes an air intake groove 521 extending obliquely rearward toward the medial side from the lateral side air intake port 421 formed in the lateral side wall 42 in the forefoot portion. Further, the other end of the air intake groove 521, that is, the end thereof on the opposite side to the end connected to the lateral side air intake port 421, is connected to the medial side air intake port 411 formed in the medial side wall 41. The configuration meant by that the air intake groove 521 extends obliquely rearward from the lateral side air intake port 421 is that the angle formed between the direction in which the air intake groove 521 extends from the lateral side air intake port 421 and the straight line orthogonal to the centerline of the shoe is 10° or more and 75° or less. The angle is preferably 15° or more and 70° or less, more preferably 20° or more and 65° or less. The direction in which the air intake groove 521 extends from the lateral side air intake port 421 means, more specifically, a direction in which the deepest line of the air intake groove 521 extends from the lateral side air intake port 421, and when the direction is not straight, it means a tangential direction of the deepest line at the open end of the lateral side air intake port 421.

The air intake groove 521 extends from the lateral side wall 42 (i.e., from the position at which the lateral side air intake port 421 is formed) through the upper surface part 2 to the medial side wall 41 (i.e., to the position at which the medial side air intake port 411 is formed). Herein, the lateral side air intake port 421 and the medial side air intake port 411 have a recessed shape opening upwardly, in which the air intake groove 521 extends between the lateral side air intake port 421 and the medial side air intake port 411 to connect them to each other.

In this embodiment, the lateral air intake port 421 and the medial side air intake port 411 each have a shape that spreads in a tapered shape toward the outside in order to facilitate the taking-in of air from the outside.

The ventilation groove 5 is formed to have a depth recessed in the thickness direction of the shoe sole 1 gradually increasing as it advances from the front side of the forefoot portion of the shoe sole 1 toward the rear side of the midfoot portion. For example, the depth of the central longitudinal ventilation groove 51*a* gradually increases as it advances from the front end on the toe side toward the rear end on the rear side of the midfoot portion. The shoe sole 1 is required to secure the strength in the forefoot portion since a relatively large amount of foot pressure from the wearer is applied to the forefoot portion of the shoe sole 1 as compared with the midfoot portion. It is possible to increase the breathability of the shoe sole 1, while sufficiently securing the strength of the shoe sole 1 by configuring the ventilation groove 5 to have a depth relatively small on the front side of the forefoot portion in which the foot pressure is increased, while configuring the ventilation groove 5 to have a depth increasing toward the rear side of the midfoot portion in which the foot pressure is reduced, as in this embodiment.

Figure 5:
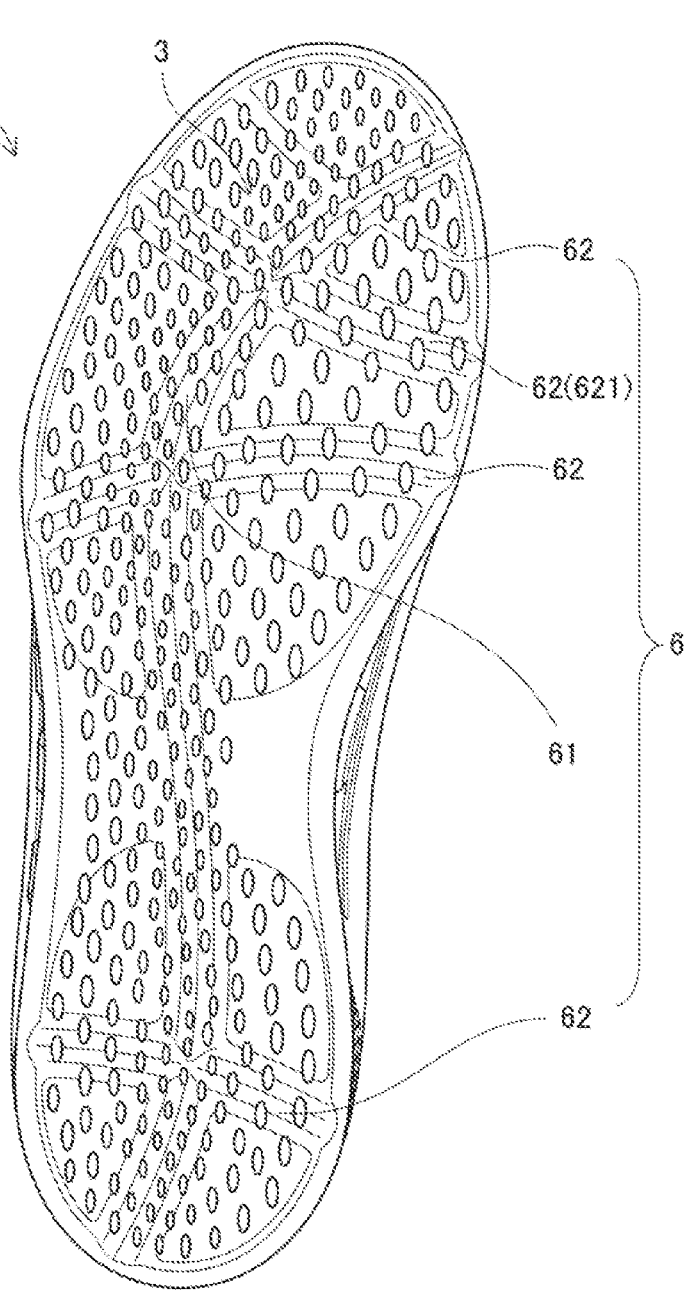
FIG. 5 is a bottom view showing the shoe sole of FIG. 1.

FIG. 5 is a bottom view of the shoe sole 1 showing the bottom surface part 3. Bending grooves 6 recessed from the lower side in the thickness direction of the shoe sole 1 are formed in the bottom surface part 3. Specifically, the bending grooves 6 include a longitudinal bending groove 61 extending in a substantially longitudinal direction from the forefoot side end to the rearfoot side end of the bottom surface part 3 through the vicinity of the center in the width direction of the shoe sole 1, and a plurality of transverse bending grooves 62 extending in a substantially width direction in the forefoot portion and the rearfoot portion from the lateral side end of the bottom surface part 3 to the medial side end, that is, from the lateral side wall 42 to the medial side end through the bottom surface part 3.

Figure 6:
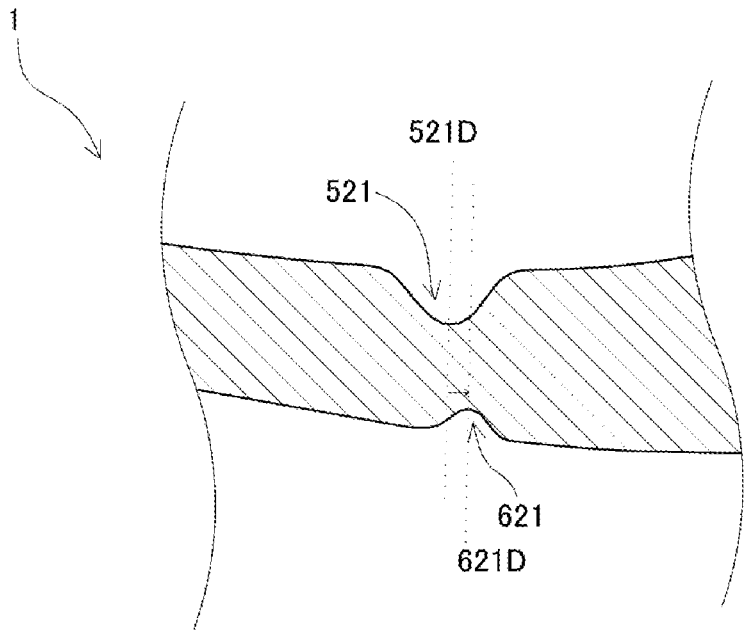
FIG. 6 is a schematic cross sectional view showing a vertical section of an area in which an air intake groove of the shoe sole of FIG. 1 is formed.

In particular, one of the transverse bending groove 62 is formed as a forefoot bending groove 621 at a position facing the air intake groove 521 formed in the upper surface part 2 in the thickness direction of the shoe sole 1 in order to make it easier to bend the shoe sole 1. Further, the deepest line passing through the forefoot (transverse) bend groove 621 is formed to be displaced rearward from the deepest line passing through the air intake groove 521. In other words, the deepest portion of the forefoot (transverse) bend groove 621 (i.e., the deepest portion herein means the most deeply recessed portion in the thickness direction, and a center in the case where the deepest portion has a certain width) is located rearward from the deepest portion of the air intake groove 521 in any cross section in the longitudinal direction of the shoe sole 1 as shown in FIG. 6. In the enlarged vertical sectional view of the shoe sole 1 shown in FIG. 6, the straight lines extending in the thickness direction through the deepest portions of the air intake groove 521 and the forefoot (transverse) bending groove 621 are respectively represented as 521D and 621D. According to such a configuration, it is possible to secure the strength of the shoe sole 1, while increasing the flexibility of the shoe sole 1 since it is possible to suppress the shoe sole 1 from having an excessively reduced thickness at a position at which the groove formed in the upper surface of the shoe sole 1 faces the groove formed in the bottom surface, while enhancing the flexibility in the upward direction required for the forefoot portion of the shoe sole 1.

As shown in FIG. 6, the deepest line passing through the forefoot (transverse) bending groove 621 preferably passes through an area on the rear side of the deepest line passing through the air intake groove 521 and on the lower side within the area forming the air intake groove 521 (i.e., within the area forming the inclined surface of the air intake groove 521 shown in FIG. 6). Further, the depth of the deepest line passing through the forefoot (transverse) bending groove 621 is preferably smaller than the depth of the deepest line passing through the air intake groove 521. In this configuration, as shown in FIG. 6, it is preferable that the inclination angle of the front side inclined surface of the forefoot (transverse) bending groove 621 (i.e., the angle with respect to the bottom surface provided with no groove in the bottom surface part 3 in the cross section in the longitudinal direction of the shoe sole 1) be smaller than the inclination angle of the rear side inclined surface of the air intake groove 521 (i.e., the angle with respect to the upper surface provided with no groove in the upper surface part 2 in the cross section in the longitudinal direction of the shoe sole 1), and it is more preferable that the relationship between these inclination angles be established in any cross section in the longitudinal direction of the shoe sole 1.

Figure 9:
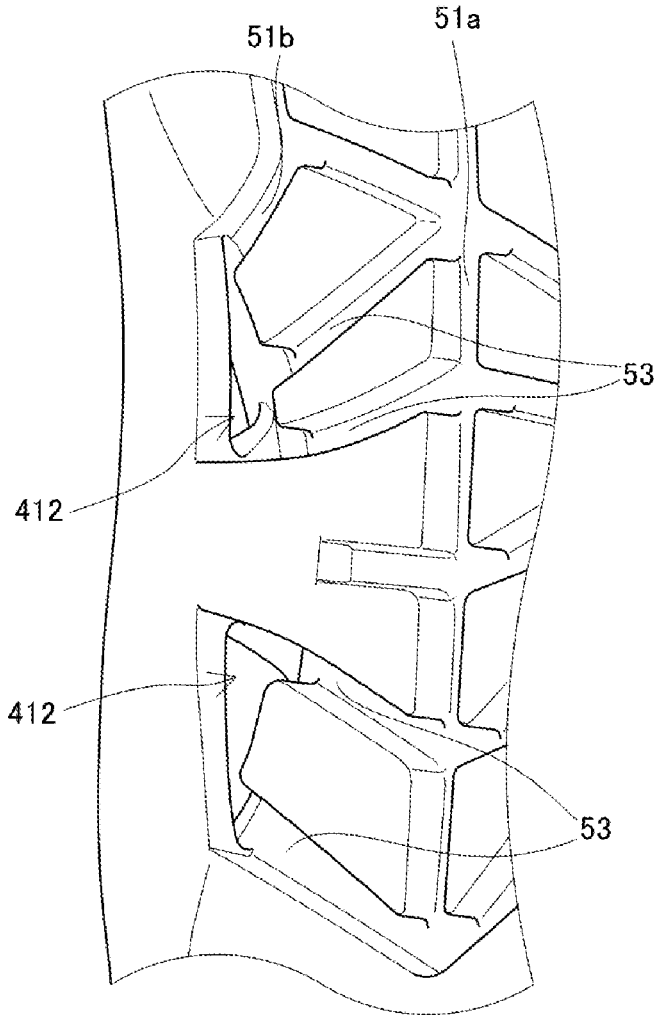
FIG. 9 is an enlarged top view showing a vicinity IX of an air outlet port on the medial side of the shoe sole of FIG. 1.
Figure 10:
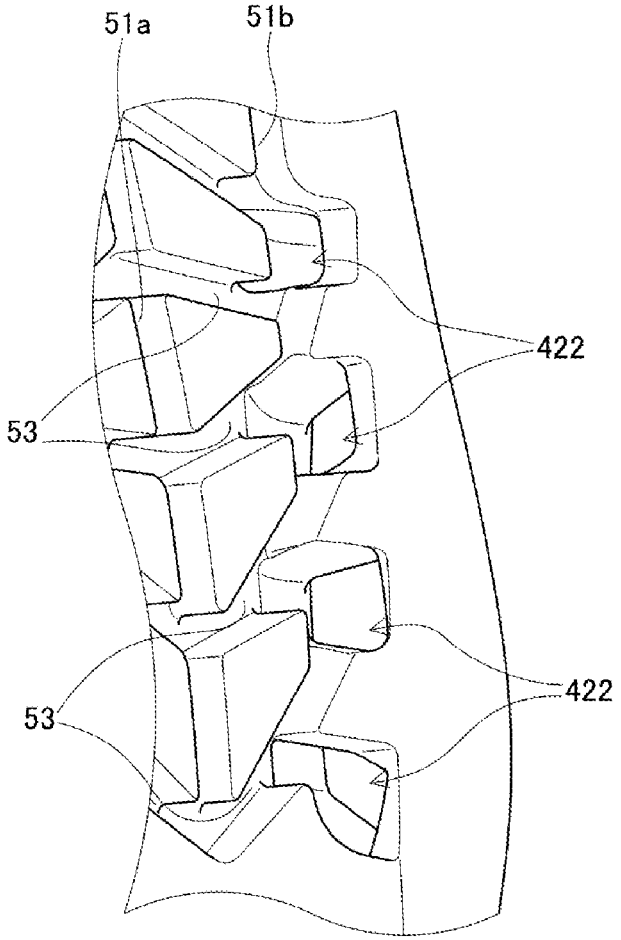
FIG. 10 is an enlarged top view showing a vicinity X of an air outlet port on the lateral side of the shoe sole of FIG. 1.

FIG. 9 and FIG. 10 are enlarged views respectively showing the vicinity of a position at which the medial side air outlet port 412 is formed and the vicinity of a position at which the lateral side air outlet port 422 is formed, in the midfoot portion of the shoe sole 1. Hereinafter, the description will be given for the structure of the medial side air outlet port 412, the lateral side air outlet port 422, and the vicinities thereof with reference to these drawings.

As described above, the medial side air outlet ports 412 and the lateral side air outlet ports 422, which are respectively formed in the medial side wall 41 and the lateral side wall 42 in the midfoot portion of the shoe sole 1, are respectively connected to the medial side air outlet spaces 551 and the lateral side air outlet space 552 formed in the medial side end and the lateral side end of the upper surface part 2, and are in communication with the ventilation grooves 5 respectively connected to the medial side air outlet spaces 551 and the lateral side air outlet space 552, specifically are in communication with either the medial side longitudinal ventilation groove 51*b* or the lateral side longitudinal ventilation groove 51*c* and a plurality of air outlet guide grooves 53 via the medial side air outlet space 551 and the lateral side air outlet space 552. In this embodiment, two medial side air outlet ports 412 are formed in the medial side wall 41, and four lateral side air outlet ports 422 are formed in the lateral side wall 42. The two medial side air outlet ports 412 are respectively connected to the medial side air outlet spaces 551 that are separately provided, and the four lateral side air outlet ports 422 are all connected to one lateral side air outlet space 552.

The bottom surface of the medial side air outlet space 551 forms an inclined surface entirely inclined from the height of the groove bottom at the connection point between the ventilation groove 5 and the medial side air outlet space 551 to the height of the lower edge of the medial side air outlet port 412 so as to become deeper from the end close to the shoe sole center toward the end close to the medial side, of the medial side air outlet space 551. The bottom surface of the lateral side air outlet space 552 is constituted by four inclined surfaces, which extend in the width direction of the shoe sole 1 from the lower edges of the lateral side air outlet ports 422 respectively and are inclined from these lower edges to the height of the groove bottom of the connection point between the ventilation groove 5 and the lateral side air outlet space 552, and a surface at the same height as that of the groove bottom.

In this embodiment, the total opening area of the medial side air outlet ports 412 and the lateral side air outlet ports 422 is larger than the total opening area of the medial side air intake port 411 and the lateral side air intake port 421. With such a configuration, the air taken in the shoe sole 1 from the air intake ports 411 and 421 is easily discharged from the air outlet ports 412 and 422.

When the medial side air outlet ports 412 and the lateral side air outlet ports 422 are compared with each other, the total opening area of the medial side air outlet ports 412 is larger than the total opening area of the lateral side air outlet ports 422. When the wearer swings the foot forward in walking or running, the air pressure on the medial side of the midfoot is more likely to be negative than on the lateral side of the midfoot. Therefore, air in the shoe sole 1 is easily discharged more efficiently by making the shoe sole 1 to have a relatively large total opening area of the medial side air outlet ports 412 formed on the medial side. As described above, the medial side air outlet ports 412 are formed in the area between the first innermost point 41A, which is the innermost point in the forefoot portion of the shoe sole 1, and the second innermost point 41B, which is the innermost point in the rearfoot portion of the shoe sole 1. The air pressure in this area is relatively likely to be negative even on the medial side of the shoe sole. In view of this point, it can be understood that air in the shoe sole 1 is easily discharged from the medial air outlet ports 412 which are relatively largely formed.

Further, the total opening area of ends of the ventilation grooves 5 located inward of the medial side air outlet ports 412, that is, the total opening area of ends of the ventilation grooves 5 opening on the medial side of the midfoot portion of the upper surface part 2 is smaller than the total opening area of ends of the ventilation grooves 5 located inward of the lateral side air outlet ports 422, that is, the total opening area of ends of the ventilation grooves 5 opening on the lateral side of the midfoot portion of the upper surface part 2. In this embodiment, more specifically, the total opening area of the medial side longitudinal ventilation groove 51*b* and the air outlet guide grooves 53 directed toward the medial side, which are open to the medial side air outlet spaces 551 connected to the medial side air outlet ports 412, on the medial side of the midfoot portion of the upper surface part 2 is smaller than the total opening area of the lateral side longitudinal ventilation groove 51*c* and the air outlet guide grooves 53 directed toward the lateral side, which are open at their joints to the lateral side air outlet space 552 connected to the lateral side air outlet ports 422, on the lateral side of the midfoot portion of the upper surface part 2. The relatively small opening area of the ventilation grooves 5 located inward of the medial side air outlet ports 412 makes it possible to increase the flow rate of air flowing from the ventilation grooves 5 into each of the medial side air outlet spaces 551 located inward of the medial side air outlet ports 412. Thereby, air is easily discharged from the medial side air outlet ports 412.

The opening area of each of the ends of the ventilation grooves 5 opening toward the medial side or the lateral side, among the ends of the ventilation grooves 5 that open on the medial side or the lateral side of the midfoot portion, can be defined as an area of each of the opening ends of the ventilation grooves that face the medial or lateral side air outlet ports 412, 422 or that face the wall surface of the medial or lateral side wall 41, 42, when the shoe sole 1 is viewed from the medial side or the lateral side. For example, the opening area of each of the ends of the ventilation grooves 5 opening toward the lateral side among the ends of the ventilation grooves 5 shown in FIG. 10 is defined as an area of the end face of each of the air outlet guide grooves 53 that are open through their open faces substantially parallel to the open faces of the medial or lateral side air outlet port 412, 422. Herein, the total opening area of the ends of the ventilation grooves 5 open to the lateral side of the midfoot portion of the upper surface part 2 is a total opening area of the end faces of the five air outlet guide grooves 53 and the lateral side longitudinal ventilation groove 51*c* that opens toward the rear side of the shoe sole 1. Further, the medial or lateral side air outlet space 551, 552 can be defined as a space existing between the end faces that can be defined as described above and the medial or lateral side air outlet port 412, 422, while being in connection therewith.

In the medial side air outlet ports 412 and the lateral side air outlet ports 422, each of the ventilation grooves 5 are formed in consideration of the position and the inclination so as not to form a passage that linearly connects the medial side air outlet port 412 and the lateral side air outlet port 422 with each other through the space in the groove. In other words, each of the ventilation grooves 5 is configured so that an obstacle formed of a part of the shoe sole 1 is located on any straight line connecting an arbitrary point within each of the medial side air outlet ports 412 and an arbitrary point within each of the outer air outlet ports 422. For example, in this embodiment, each of the air outlet guide grooves 53 is formed to have an end, which is formed to allow the air outlet guide groove 53 to be inclined toward the front side or the rear side, so as not to be positioned on the straight line connecting each of the medial side air outlet ports 412 and each of the lateral side air outlet ports 422. When a passage, which linearly connects the medial side air outlet port 412 and the lateral side air outlet port 422 with each other via a space inside the groove, exists in the shoe sole 1, an airflow from the lateral side air outlet port 422 to the medial side air outlet port 412 or vice versa is likely to cause, and hence cause hindrance to an airflow from the air intake ports 411 and 421 to the air outlet ports 412 and 422. In this embodiment, such ventilation grooves 5 are formed not to form such a passage so that less hindrance is caused to the airflow from the air intake ports 411 and 421 to the air outlet ports 412 and 422, and the breathability of the shoe sole 1 is enhanced.

Meanwhile, the ventilation grooves 5 are formed to allow the medial side air outlet ports 412 and the lateral side air outlet ports 422 not to be linearly arranged with each other, while being in communication with each other. Therefore, for example, when wind in the lateral direction is blown into the shoe sole 1 of the wearer who is in a non-moving state, air can pass from the medial side outlet ports 412 to the lateral side air outlet ports 422, or vice versa so that the breathability can be exhibited to a certain degree in such a situation.

Figure 3:
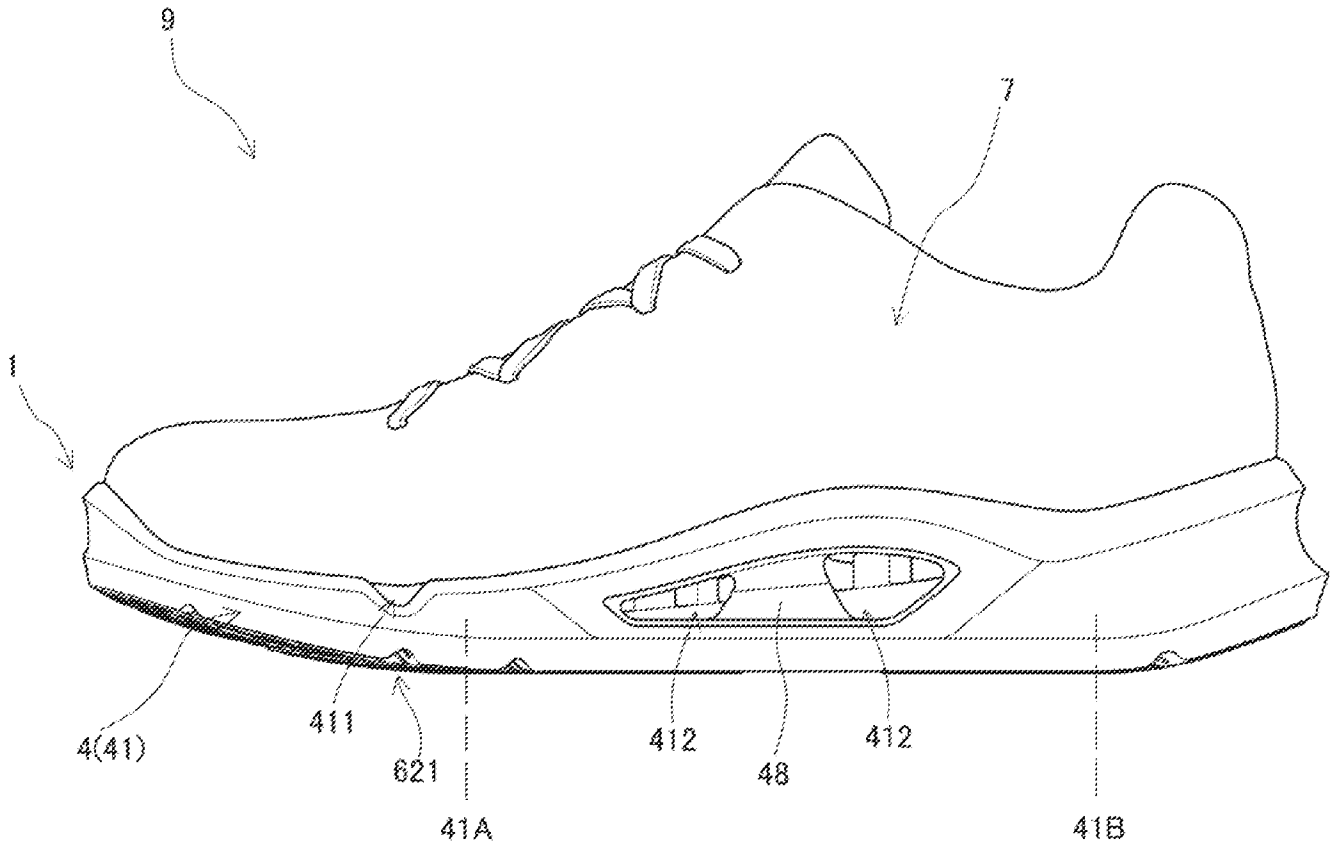
FIG. 3 is a medial side view showing the shoe sole of FIG. 1 and a shoe including the shoe sole.
Figure 4:
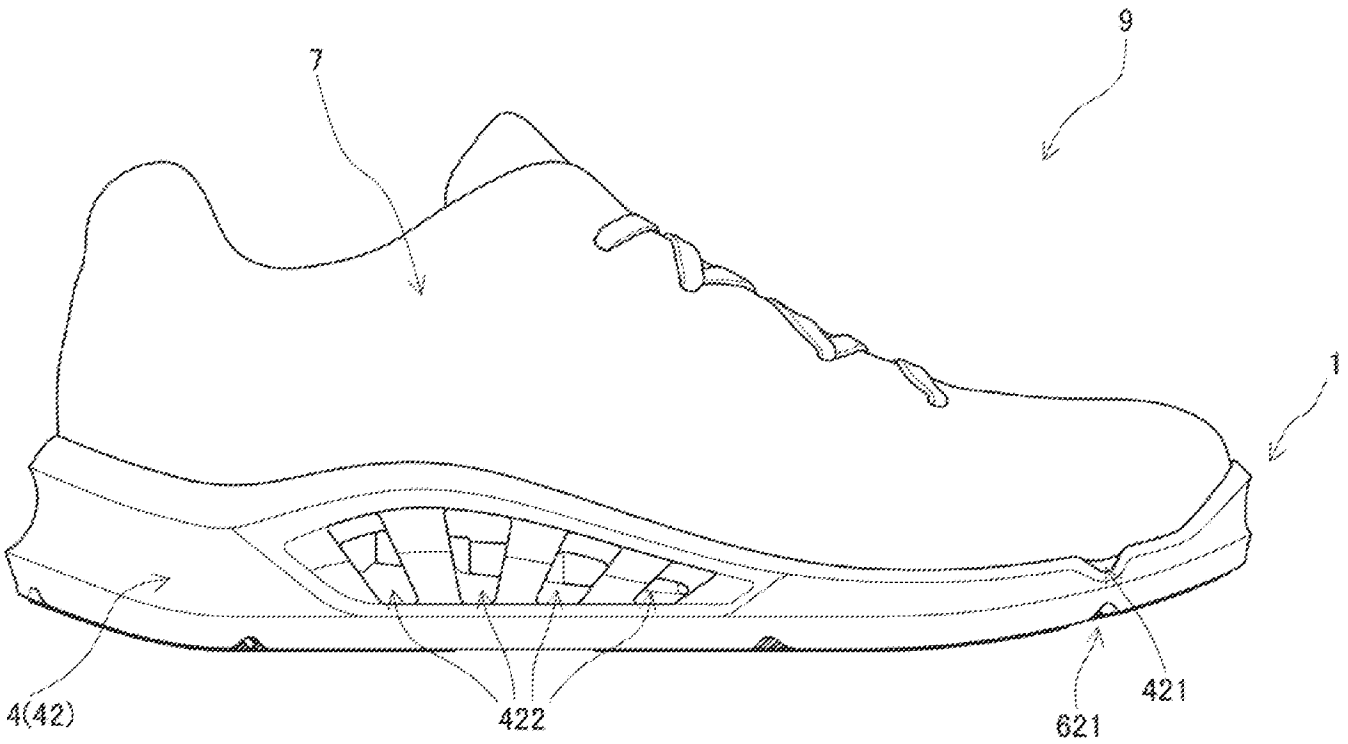
FIG. 4 is a lateral side view showing the shoe sole of FIG. 1 and the shoe including the shoe sole.

Turning to FIG. 3 and FIG. 4, the description will be given in connection with the medial side air outlet ports 412 and the lateral side air outlet ports 422. In this embodiment, the side wall part 4 (the medial side wall 41 and the lateral side wall 42) is provided with an extension 45 at positions at which the medial side air outlet ports 412 and the outer air outlet ports 422 are formed. With such a configuration, the shoe sole 1 of this embodiment is advantageous in that the opening area of each of the medial side air outlet ports 412 and each of the lateral side air outlet ports 422 can be secured with no need to make the thickness of the shoe sole 1 much greater.

Further, a reinforcing column part 48 is provided between the two medial side air outlet ports 412 in the medial side wall 41. The reinforcing column part 48 serves as a reinforcing member to suppress distortion of the area around the medial side air outlet port 412 by reinforcing between the two air outlet ports 412 each having a large opening. In this embodiment, the reinforcing column part 48 has a width corresponding to the front-rear direction of the shoe sole 1 larger than the width of the lower end edge of any of the medial side air outlet ports 412 at the height of the lower end of the medial side air outlet ports 412. Such a configuration enables to effectively suppress the distortion of the area around the medial side air outlet ports 412. Further, in this embodiment, the reinforcing column part 48 is formed as a part of the medial side wall 41. Moreover, the extension 45 which is a part of the medial side wall 41 also serves as a reinforcing member for the area above the medial side air outlet ports 412.

Figure 11:
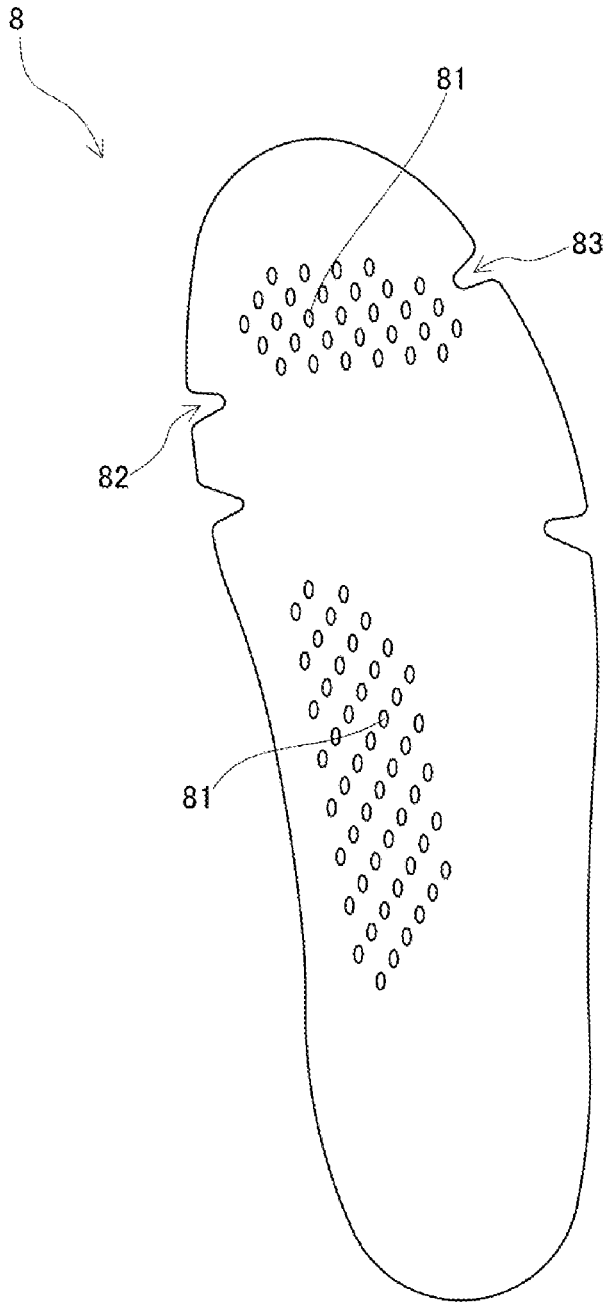
FIG. 11 is a top view showing an inner sole mounted on the shoe sole of FIG. 1.
Figure 12:
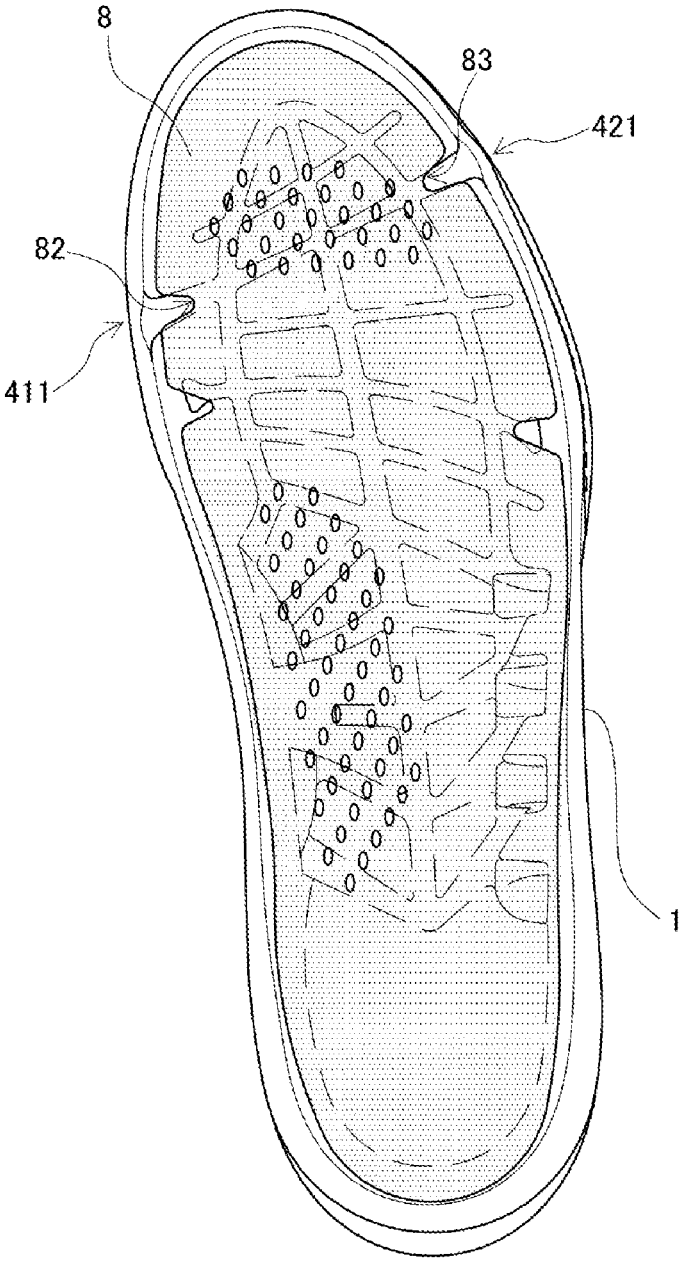
FIG. 12 is a top view showing a state in which the inner sole of FIG. 11 is mounted on the shoe sole of FIG. 1.

Subsequently, the description will be given on a shoe 9 including the shoe sole 1 of this embodiment. As shown in FIG. 3 and FIG. 4, the shoe 9 of this embodiment includes the shoe sole 1 and an upper member 7 provided above the upper surface part 2 of the shoe sole 1 to cover the dorsum side of the foot of the wearer. In addition, in the shoe 9 of this embodiment, an inner sole 8 as shown in FIG. 11 is placed above the shoe sole 1 as shown in FIG. 12. The inner sole 8 may be mounted directly on the shoe sole 1 or mounted via another shoe sole member mounted on the shoe sole 1. For example, the shoe 9 of this embodiment may further include an insole, which is not shown herein, between the shoe sole 1 and the inner sole 8. The insole preferably has breathability to such an extent as not to prevent air communication between the shoe sole 1 and the inner sole 8. Such an insole may be, for example, a bottom surface part of the upper member 7. In such a case, the upper member 7 may have its bottom surface part mounted as an insole on the upper surface part 2 of the shoe sole 1, and the bottom surface part and the upper surface part 2 are bonded to each other to be thereby joined to the shoe sole 1.

FIG. 11 is a top view of the inner sole 8 that is mounted on the shoe sole 1 of this embodiment for use. A plurality of small vent holes 81 are formed in the surface of the inner sole 8. The plurality of small vent holes 81 are in communication with the ventilation grooves 5 formed in the upper part 2 of the shoe sole 1 in the state where the inner sole 8 is mounted on the shoe sole 1. This a configuration enables air flowing in the ventilation grooves 5 of the shoe sole 1 to be brought into contact with the sole of the foot of the wearer, who wears the shoe 9, through the small vent holes 81 formed in the inner sole 8, so that the comfort of the wearer is improved.

In this embodiment, the plurality of small vent holes 81 are formed over the forefoot portion and the planter arch portion of the inner sole 8. Each of the forefoot portion and the planter arch portion of the inner sole 8 has an area that does not come into direct contact with the foot of the wearer during walking or running and hence is not applied with a foot pressure generated by the wearer. With the plurality of small vent holes 81 formed in such areas, the inner sole 8 enables the ease of air ventilation within the shoe through the small vent holes 81. Further, the plurality of small vent holes 81 are formed in an area other than the area corresponding to the metatarsophalangeal joint. The area corresponding to the metatarsophalangeal joint on the shoe sole is an area to which a relatively large foot pressure from the wearer is applied. Thus, in the case where the plurality of small vent holes 81 are not formed in the area corresponding to the metatarsophalangeal joint of the inner sole 8, the discomfort of the wearer due to the contact of the sole of the wearer with the plurality of small vent holes 81 is alleviated. However, the area in which the plurality of small vent holes 81 are formed is not limited to the aforementioned area. For example, the plurality of small vent holes 81 may be provided entirely in the inner sole 8.

Further, cutouts 82 and 83 are formed at the medial side end and the lateral side end of the forefoot portion of the inner sole 8. As shown in FIG. 12, the cutouts 82 and 83 are formed at areas respectively corresponding to the air intake ports 411 and 412 of the shoe sole 1 in the state where the inner sole 8 is mounted on the shoe sole 1. Such a configuration makes it relatively easy to take air from the air intake ports 411 and 412 into the shoe sole 1 in the shoe including the shoe sole 1 and the inner sole 8.

The shoe sole 1 and the shoe 9 of this embodiment are configured as above and thus have the following advantages.

According to the shoe sole 1 of this embodiment, at least a part of the ventilation grooves 5 constitute air intake groove 521 extending obliquely rearward from the lateral side air intake port 421 toward the medial foot side (first form). When the wearer who wears the shoe including the shoe sole 1 swings the foot forward in walking or running, air colliding with the shoe is forced into the ventilation grooves 5 of the shoe sole 1 from the lateral side air intake port 421 provided in the forefoot portion of the shoe sole 1. At this time, in the shoe sole 1 of this embodiment, air taken into the grooves 5 of the shoe sole 1 from the lateral side air intake port 421 is accelerated to flow rearward of the shoe sole 1 since the air intake groove 521 extending obliquely rearward toward the medial side extends from the lateral side air intake port 421 formed in the lateral side wall 42. Thereby, air taken into the groove 5 of the shoe sole 1 is fed to the medial side air outlet ports 412 and/or the lateral side air outlet ports 422 formed in the midfoot portion of the shoe sole 1, and thereby can be easily discharged from the air outlet ports 412 and 422. Accordingly, the shoe sole 1 of this embodiment has enhanced breathability in the shoe on the basis of these features.

Further, according to the shoe sole 1 of this embodiment, the total opening area of the medial side air outlet ports 412 and the lateral air outlet ports 422 is larger than the total opening area of the medial side air intake port 411 and the lateral side air intake port 421 (second form). In the shoe sole 1 of this embodiment, air taken into the grooves 5 of the shoe sole 1 is easily discharged from the air outlet ports 412 and 422 since the total opening area of the medial side air outlet ports 412 and the lateral side air outlet ports 422 is larger than the total opening area of the medial side air intake port 411 and the lateral side air intake port 421. Accordingly, the shoe sole 1 of this embodiment has enhanced breathability inside the shoe on the basis of these features.

Further, according to the shoe sole 1 of this embodiment, the medial side air outlet ports 412 in the medial side wall 41 are formed in the area between the first innermost point 41A which is the innermost point in the forefoot portion of the shoe sole 1, and the second innermost point 41B, which is the innermost point in the rearfoot portion of the shoe sole 1, and at least a part of the ventilation grooves 5 constitute the air intake groove 521 extending obliquely rearward from the lateral side air intake port 421 toward the medial foot side (third form). The area between the first innermost point 41A and the second innermost point 41B of the medial side wall 41 is an area in which air is most separated in walking or running of the wearer and the air pressure is more likely to be negative. Therefore, air taken into the ventilation grooves 5 of the shoe sole 1 is more easily discharged from the air outlet ports 412 and 422 by forming the medial side air outlet port 412 in this area. Accordingly, the shoe sole 1 of this embodiment has enhanced breathability inside the shoe also on the basis of these features.

Further, the shoe 9 of this embodiment including the shoe sole 1 thus has enhanced breathability inside the shoe on the basis of the aforementioned features. In addition, the inner sole 8 with a plurality of small vent holes 81 formed therein for communication with the ventilation grooves 5 is mounted in the shoe 9 of this embodiment. Thereby, the shoe 9 enables air flowing in the ventilation grooves 5 of the shoe sole 1 to be brought into contact with the sole of the foot of the wearer who wears the shoe 9 through the small vent holes 81 formed in the inner sole 8, so that the comfort of the wearer is improved.

The shoe sole and the shoe according to the present invention are not limited to the configuration of the aforementioned embodiment. Further, the shoe sole and the shoe according to the present invention are not limited to those having the aforementioned operational effects. Various modifications can be made to the shoe sole and the shoe according to the present invention without departing from the gist of the present invention.

Figure 13:
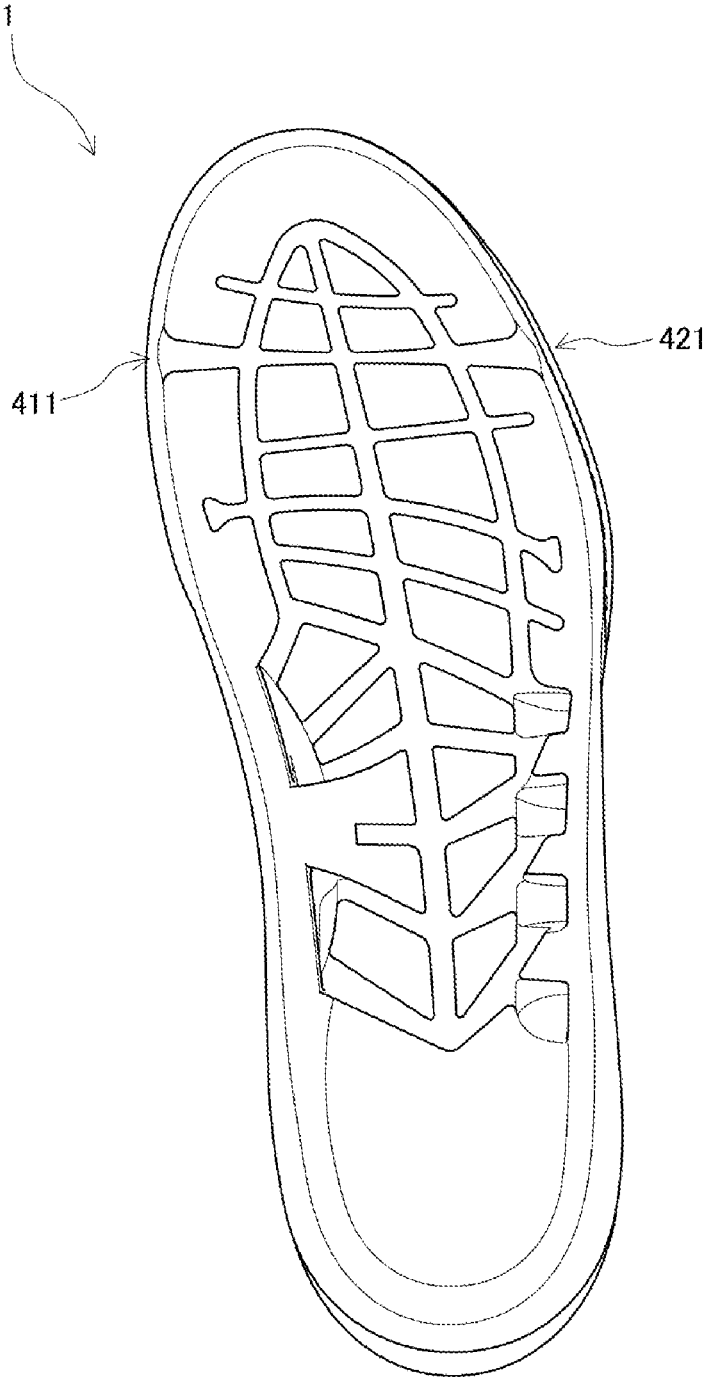
FIG. 13 is a perspective view showing a shoe sole according to another embodiment of the present invention.
Figure 14:
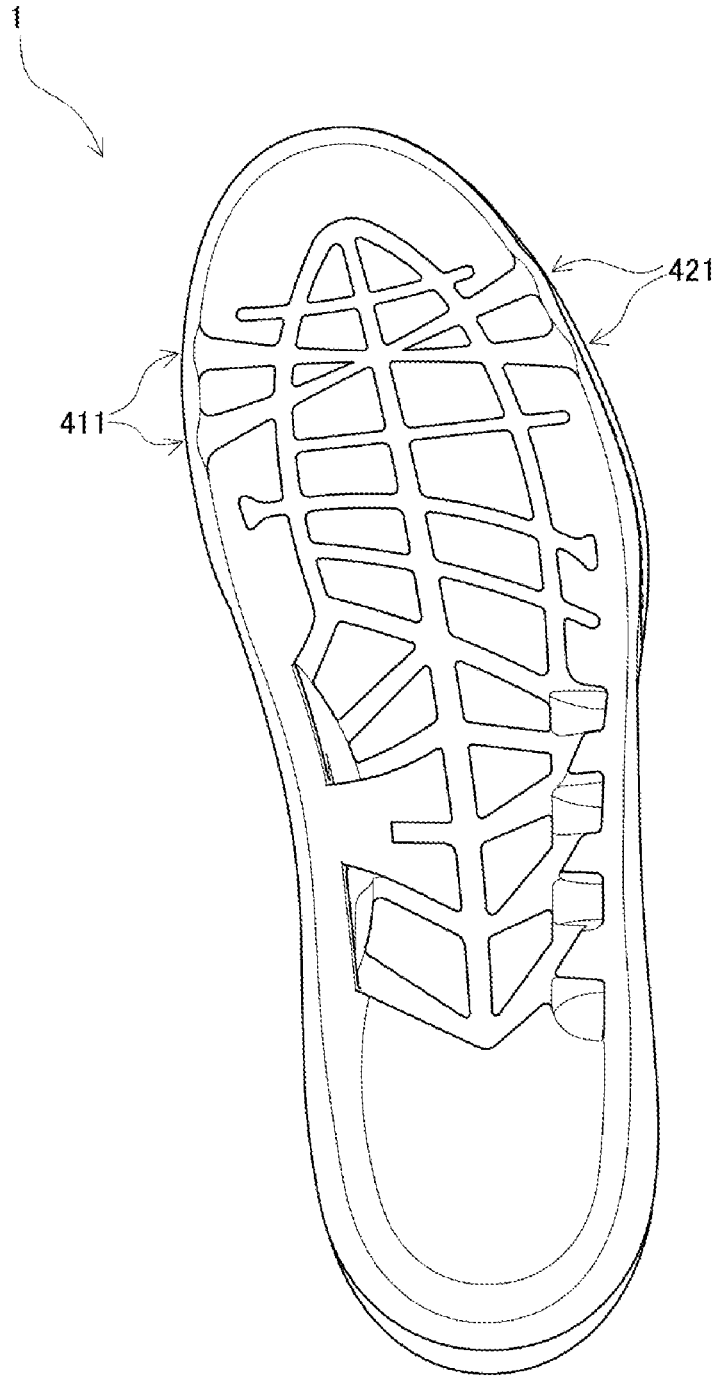
FIG. 14 is a perspective view showing a shoe sole according to still another embodiment of the present invention.

For example, the air intake groove 521 in the aforementioned embodiment extends obliquely rearward from the lateral side air intake port 421 formed in the lateral side of the shoe sole 1 toward the medial side, but the air intake groove of the shoe sole of the present invention is not limited to this embodiment, and may extend rearward from either the medial side air intake port or the lateral side air intake port. For example, the air intake groove 521 may extend obliquely rearward from the medial side air intake port 411 formed in the medial side toward the lateral side, as shown in FIG. 13. Further, a plurality of air intake grooves may be formed in the shoe sole of the present invention. In this case, the oblique directions in which the plurality of air intake grooves extend may be the same as or different from each other. For example, the shoe sole 1 may be formed such that the air intake groove 521 extending obliquely rearward from the lateral side intake port 421 toward the medial side and the air intake groove 521 extending obliquely rearward from the medial side intake port 411 toward the lateral side cross each other as shown in FIG. 14.

Figure 15:
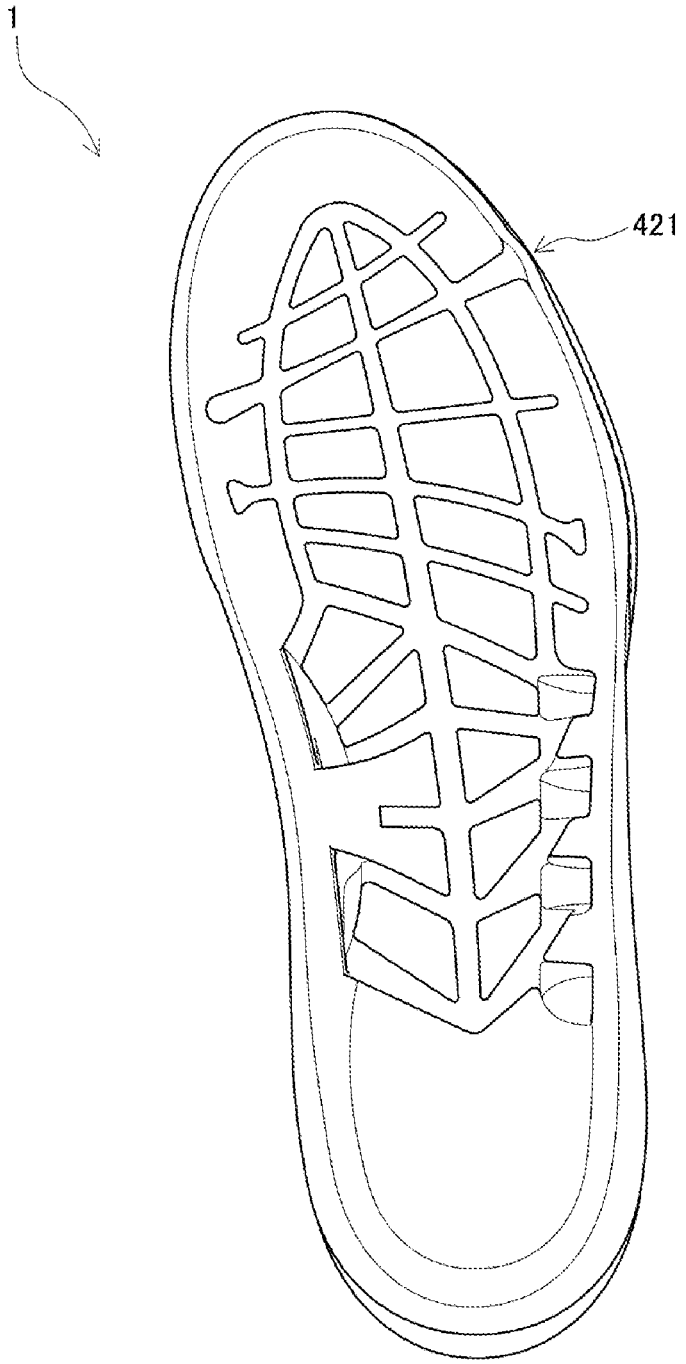
FIG. 15 is a perspective view showing a shoe sole according to yet another embodiment of the present invention.

The air intake port in the aforementioned embodiment is constituted by both of the lateral side air intake port 421 formed in the lateral side wall 42 and the medial side air intake port 411 formed in the medial side wall 41, but the shoe sole of the present invention may be constituted by only one of the lateral side air intake port 421 and the lateral side air intake port 411. For example, the shoe sole 1 may not include the medial side air intake port 411, while including only the lateral side air intake port 421, as shown in FIG. 15. In the case where the shoe sole 1 includes only one air intake port, the air intake port is preferably the lateral side air intake port 421 formed in the lateral side wall 42. The shape of each of the lateral side air intake port 421 and the lateral side air intake port 411 is not limited to the tapered shape as in the aforementioned embodiment, and may have a straight shape.

Further, the configuration of the ventilation groove 5 is not limited to that shown in the aforementioned embodiment as long as the air intake port and the air outlet port are in communication with each other, and can be appropriately modified. For example, the number of the longitudinal ventilation grooves 51, the number of transverse ventilation grooves 52, and the number of the air outlet guide grooves 53 included in the ventilation grooves 5 may be larger or smaller than those in the aforementioned embodiment. Further, the ventilation grooves 5 may optionally include a straight groove and a curved groove, and may include a groove of a polygonal line shape, a wave line shape, or a labyrinth shape. In the case where the ventilation grooves 5 are constituted by grooves in a complicated shape including such as a polygonal line shape, a wave line shape, and a labyrinth shape, an advantage that water or any foreign matter are hardly intruded into the shoe sole 1 can be obtained. Further, the depth of the ventilation grooves 5 may be constant in the width direction, or may have different widths in the medial side and the lateral side. Particularly in the forefoot portion, it is possible to have a depth becoming smaller toward the medial side and the lateral side from the center at which the foot pressure is large.

In the aforementioned embodiment, the total opening area of the medial side air outlet ports 412 is larger than the total opening area of the lateral side air outlet ports 422, but the relationship between these opening areas in the shoe sole of the present invention is not limited to this, and the total opening area of the lateral side air outlet ports 422 may be larger than the total opening area of the medial side air outlet ports 412, or both may be equal to each other. Further, the positions at which the medial side air outlet ports 412 are formed are not limited to the area between the first innermost point and the second innermost point as in the aforementioned embodiment, but may be formed at any positions of the medial side wall 41 in the midfoot portion. Further, it is not essential that the side wall part 4 include the extension 45.

In the aforementioned embodiment, the deepest line passing through the forefoot (transverse) bending groove 621 is formed to be located rearward of the deepest line passing through the air intake groove 521 in any cross section in the longitudinal direction of the shoe sole 1, but this positional relationship is not necessarily limited in the shoe sole of the present invention. For example, the deepest line passing through the forefoot (transverse) bending groove 621 may not be located partially or entirely rearward of the deepest line passing through the air intake groove 521, as long as sufficient flexibility and strength required for the shoe sole 1 can be maintained. Further, the bending grooves 6 including the forefoot (transverse) bending groove 621 are not an essential feature of the shoe sole 1, and the shoe sole 1 may not include a part or all of the bending grooves 6 described in the aforementioned embodiment.

Figure 16:
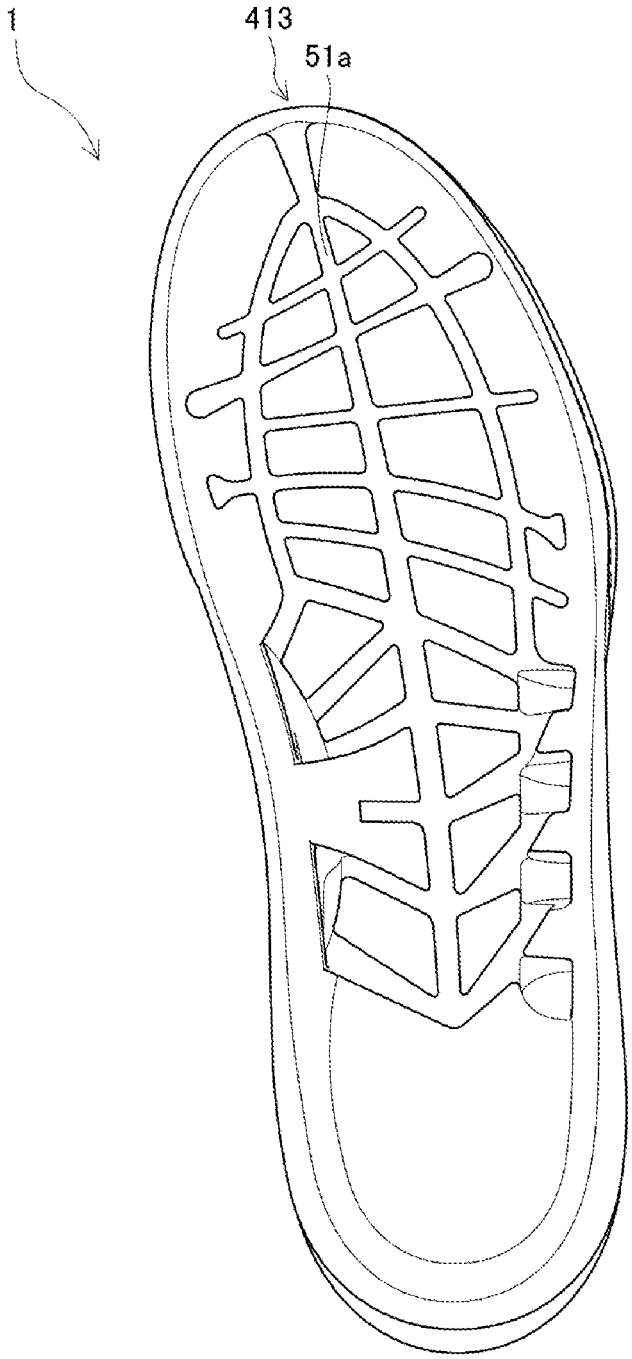
FIG. 16 is a perspective view showing a shoe sole according to still yet another embodiment of the present invention.

As long as the shoe sole 1 includes the feature of the first form of the present invention, that is, the feature that the air intake groove 521 extends obliquely rearward from at least one of the medial side air intake port 411 and the lateral side air intake port 421 formed in at least one of the medial side wall 41 and the lateral side wall 42, the shoe sole 1 may not include the feature of the second form of the present invention, that is, the feature that the total opening area of the air outlet ports 412 and 422 is larger than the total opening area of the air intake ports 411 and 421. Similarly, as long as the shoe sole 1 includes the aforementioned feature of the second form of the present invention, the shoe sole 1 does not necessarily include the aforementioned feature of the first form. That is, the present invention can achieve the effect of enhancing the breathability of the shoe sole as long as the present invention includes the feature of any one of the first form and the second form. Of course, it is obvious that the aforementioned effect is further exhibited if the present invention includes the features of both the first form and the second form. For example, in the case where the shoe sole 1 has the feature of the second form of the present invention, an air intake port 413 may be formed on the toe side of the side wall part 4, from which the central longitudinal ventilation groove 51*a* extends as shown in FIG. 16.

Figure 17:
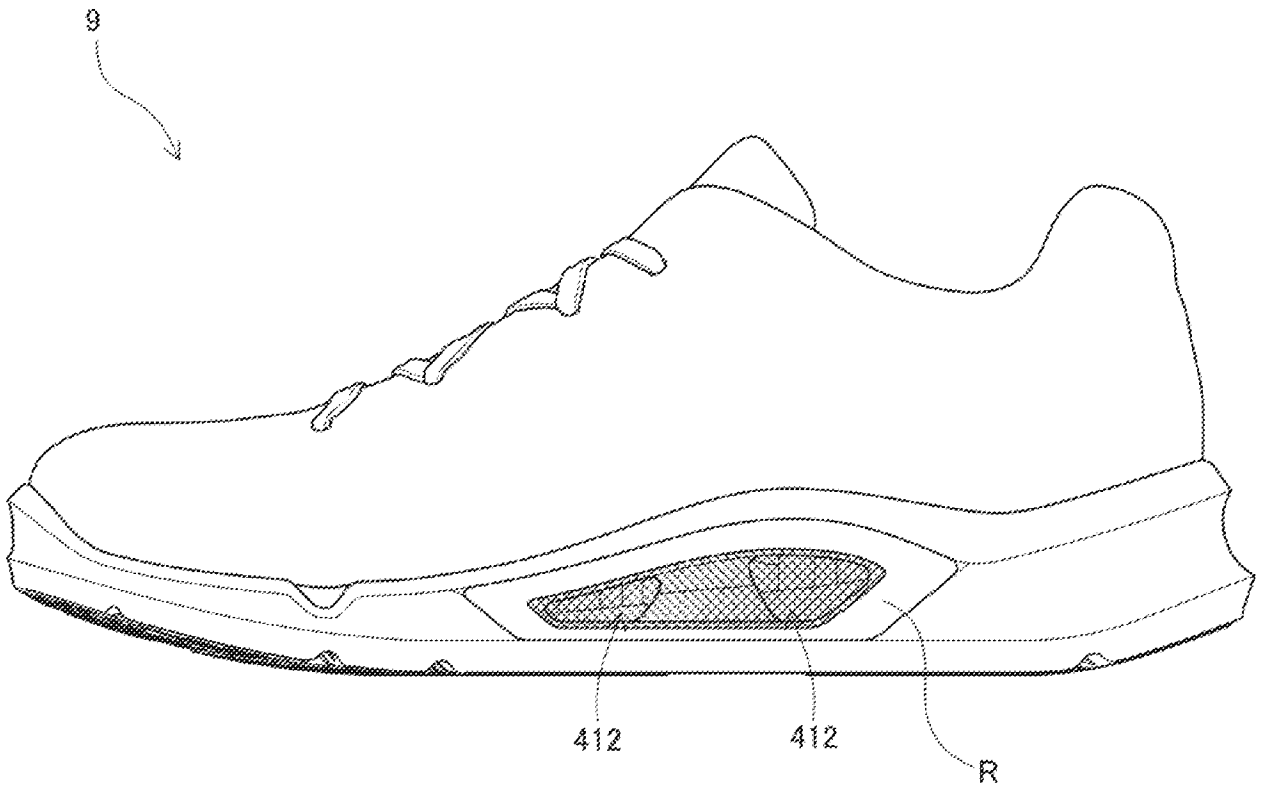
FIG. 17 is a left side view showing the shoe sole of FIG. 1 and a shoe including the shoe sole, in which a reinforcing member separate from the shoe sole is provided at the air outlet port on the medial side of the medial side wall of the shoe sole.

In the aforementioned embodiment, the reinforcing column part 48, which is a part of the medial side wall 41, is provided as a reinforcing member to suppress the distortion of the area around the medial side air outlet port 421, but as a substitute or in addition to the reinforcing column part 48, the medial side wall 41 of the shoe sole of the present invention may be provided with a reinforcing member R as a separate member to suppress the distortion of the area around the medial side air outlet port. The reinforcing member R may be, for example, attached to the medial side wall 41 so as to serve as an outer frame that surrounds the periphery of the medial side air outlet port 421 as shown in FIG. 17. The reinforcing member R may be, for example, a separate frame body formed of a resin such as TPU or nylon, which is fitted into the medial side wall 41, or may be configured such that a part of an outer sole additionally provided on a shoe sole is wound upward. The reinforcing member R is not limited to a member made of a resin, and may be a member made of metal or the like. At this time, the reinforcing member R may be provided with a mesh member in the area inside the frame in order to prevent foreign matter from entering the medial side air outlet ports 412 as shown in FIG. 17. Further, the reinforcing member such as the reinforcing column part 48 or the reinforcing member R may be provided not only around the medial side air outlet ports 412 in the lateral side wall 42 but also around the lateral side outlet ports 422.

Although detailed description beyond the description above will not be repeated here, conventionally known technical matters on shoe sole and shoe may be optionally employed in the present invention even if the matters are not directly described in the above.

Hereinafter, the present invention will be elucidated by way of specific examples and comparative examples of the present invention. However, the present invention is not limited to the following examples.

EXAMPLE

An upper member made of a double-Raschel mesh knitted with a general polyester yarn provided in a commercially available shoe was attached to a shoe sole made of a foamed resin having a structure similar to that of the shoe sole 1 of the aforementioned embodiment shown in FIG. 1. Thereafter, an inner sole made of a foamed resin having a structure similar to that of the inner sole 8 of the aforementioned embodiment shown in FIG. 11 was mounted on the shoe sole. The shoe thus produced was taken as a shoe of Example.

COMPARATIVE EXAMPLE

Figure 18:
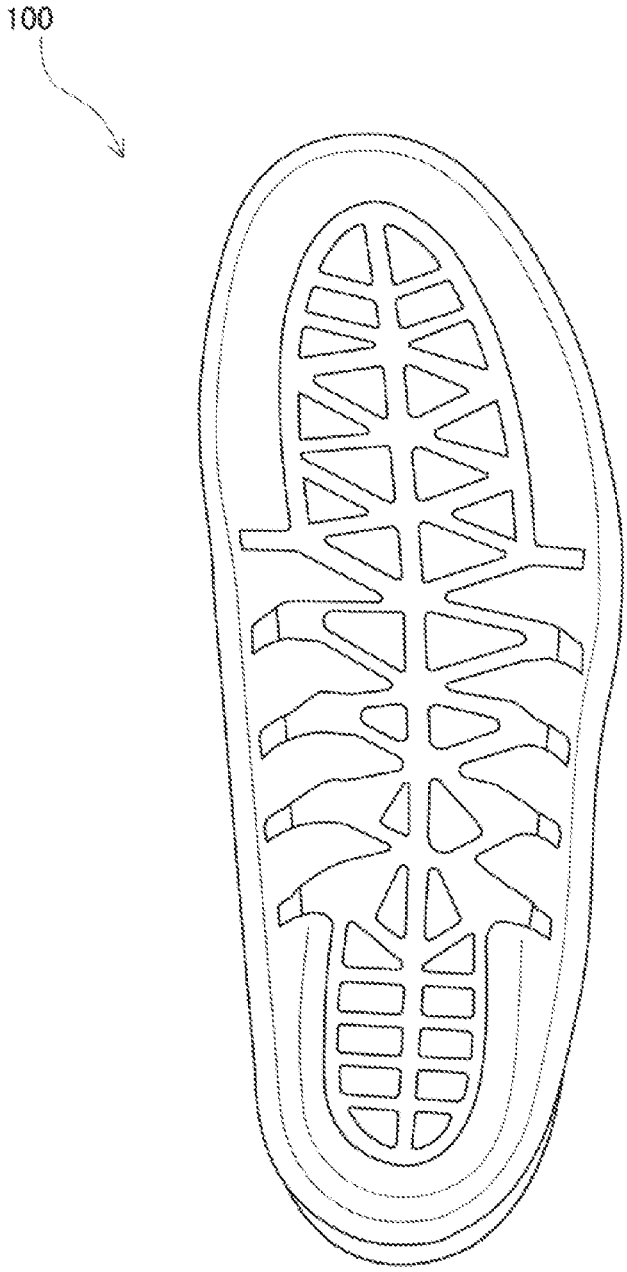
FIG. 18 is a top view showing a shoe sole of Comparative Example.

Instead of the shoe sole used in Example, a shoe of Comparative Example was obtained in the same manner as in Example except that a shoe sole 100 made of a foamed resin having a structure shown in FIG. 18 was used. The shoe sole used in this Comparative Example does not include an air intake port in the forefoot portion, and is formed such that the total opening area of the medial side air outlet ports formed in the midfoot portion is equal to the total opening area of the lateral side air outlet ports formed in the midfoot portion.

Measurement of Breathability

Figure 19:
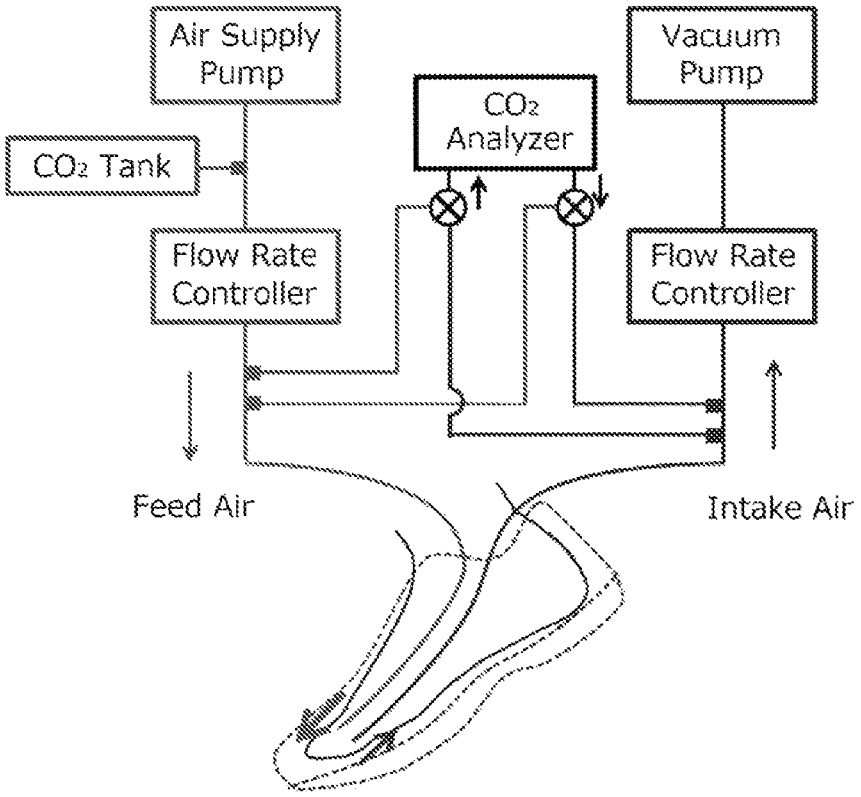
FIG. 19 is a schematic diagram showing a tracer gas method that is a measurement method for the breathability in Example and Comparative Example.

The breathability of each of the shoes according to Example and Comparative Example during running was measured in the manner as mentioned below using the tracer gas method shown in FIG. 19.

Figure 20:
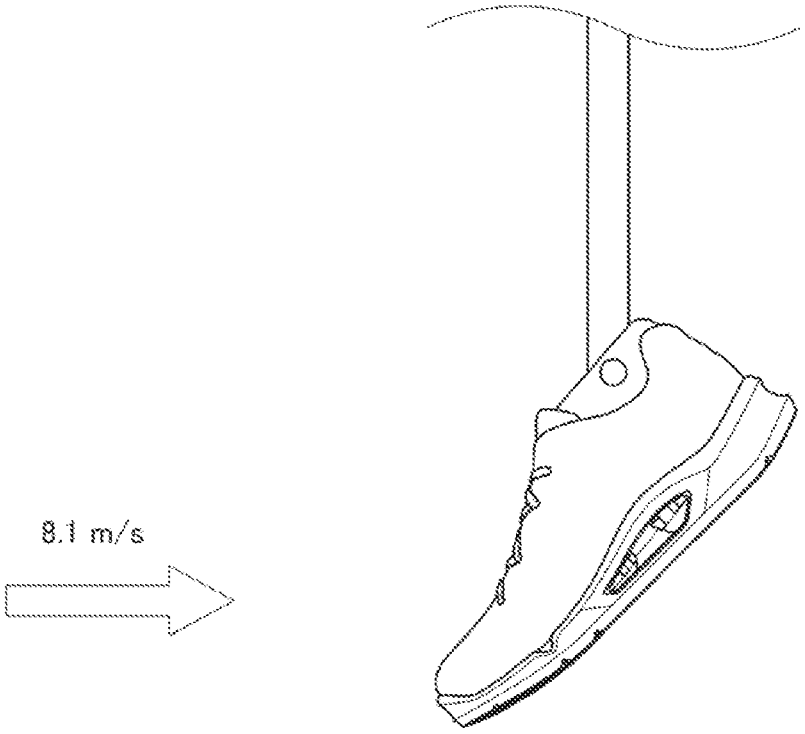
FIG. 20 is a schematic view showing a measuring device of the breathability in Example and Comparative Example.

Each of the shoes according to Example and Comparative Example was equipped on an artificial foot and fixed with a hexagonal rod passing through an ankle portion of the artificial foot in a state where the shoe is tilted forward at an angle of 45° as shown in FIG. 20. Thereafter, $CO_2$ as a tracer gas was mixed with air, and then this gas was supplied into the shoe through an air-feeding silicone tube arranged in the artificial foot, and air in the shoe was simultaneously discharged to the outside of the shoe through an air-discharging silicone tube also arranged in the artificial foot. At this time, an electromagnetic air pump was used for air supply and discharge, and the flow rate of the air supply and the flow rate of the air discharge were adjusted to be equal to each other using a flow controller. Further, $CO_2$ concentration each on the air supply side and the air discharge side was intermittently measured using a $CO_2$ analyzer. An average value after the concentration was sufficiently stabilized was used as the $CO_2$ concentration.

When the flow rate of the gas by the pump is $Q_{pump}$, the flow rate of the gas by the ventilation inside the shoe is $Q_{vent}$, the $CO_2$ concentration on the air supply side is $C_{in}$, the $CO_2$ concentration on the air discharge side is $C_{out}$, and the $CO_2$ concentration of the ambient air is $C_{amb}$, the following formula (1) is established since it is considered that the amount of $CO_2$ flowing into the shoe and the amount of flowing out from the shoe are equal to each other in the case where the $CO_2$ concentration inside the shoe is held at a steady state.

$$Q_{pump} \times C_{in} + Q_{vent} \times C_{amb} = (Q_{pump} + Q_{vent}) \times C_{out} \quad (1)$$

Accordingly, the in-shoe ventilation amount $Q_{vent}$ can be obtained from the following formula (2) which is a conversion of formula (1).

$$Q_{vent} = Q_{pump} \times (C_{in} - C_{out}) / (C_{out} - C_{amb}) \quad (2)$$

The air flow set at 8.1 m/s on the basis of the average swing speed of the foot during running was blown from the front of the shoe having the inside thus filled with the tracer gas to measure the ventilation amount as described above. The measurement location for the ventilation amount at this time was the sole side of a toe crotch. The results are shown in Table 1 and FIG. 21.

TABLE 1

| | Shoe sole ventilation amount (L/min) |
|---|---|
| Example | 1.7 |
| Comparative Example | 0.4 |

Figure 21:
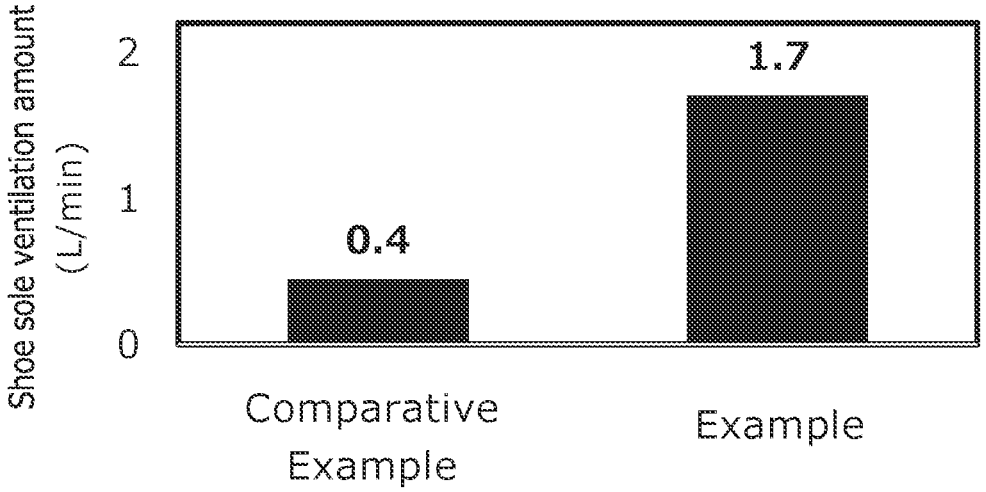
FIG. 21 is a graph showing comparison of the breathability between the shoes of Example and Comparative Example.

As shown in Table 1 and FIG. 21, it can be seen that the shoe of Example including the shoe sole of the present invention has greatly improved breathability during running as compared with the shoe of Comparative Example.

REFERENCE SIGNS LIST

1: Shoe sole
2: Upper surface part
3: Bottom surface part
4: Side wall part
41: Medial side wall
411: Medial side air intake port
412: Medial side air outlet port
42: Lateral side wall
421: Lateral side air intake port
422: Lateral side air outlet port
5: Ventilation groove
51: Longitudinal ventilation groove
51*a*: Central longitudinal ventilation groove
51*b*: Medial side longitudinal ventilation groove
51*c*: Lateral side longitudinal ventilation groove
52: Transverse ventilation groove
521: Air intake groove
53: Air outlet guide groove
551: Medial side air outlet space
552: Lateral side air outlet space
6: Bending groove
61: Longitudinal bending groove
62: Transverse bending groove
621: Forefoot bending groove (transverse bending groove)
7: Upper member
8: Inner sole
81: Small vent hole
82: Medial side cutout
83: Lateral side cutout
9: Shoe

The invention claimed is:

1. A shoe sole comprising: an upper surface part configured to enable an upper member to be provided thereover; a bottom surface part configured to be in contact with the ground; and a side wall part configured to connect an outer peripheral end of the upper surface part and an outer peripheral end of the bottom surface part in a thickness direction of the shoe sole, wherein ventilation grooves recessed in the thickness direction of the shoe sole from an upper side are formed in the upper surface part, the shoe sole has a forefoot portion that has at least one air intake port formed in the side wall part to be in communication with the ventilation grooves and draw air from outside into the ventilation grooves, the shoe sole has a midfoot portion that has at least one air outlet port formed in the side wall part to be in communication with the air intake port through the ventilation grooves and discharge air in the ventilation groove to the outside, at least a part of the ventilation grooves constitutes an air intake groove extending from the at least one air intake port, a forward-most one of the at least one air intake port in a length direction of the shoe sole is located on a lateral side wall on a lateral side in the side wall part, the at least one air outlet port of the midfoot portion has an opening area larger than an opening area of the at least one air intake port of the forefoot portion, the air intake groove extends obliquely rearward from the lateral side of the shoe sole to the medial side, the air outlet port comprises at least one medial side air outlet port formed in the medial side wall and at least one lateral side air outlet port formed in the lateral side, a total opening area of the medial side outlet port is larger than a total opening area of the lateral side air outlet port, and the ventilation grooves each are formed to have a depth recessed in the thickness direction of the shoe sole gradually increasing as it advances from the front side of the forefoot portion toward the rear side of the midfoot portion.

2. The shoe sole according to claim 1, wherein the at least one air intake port has a shape that spreads in a tapered shape toward the outside.

3. The shoe sole according to claim 1, wherein the at least one air intake port is formed in each of the medial side wall and the lateral side wall, each of the air intake port formed in the medial side wall and the air intake port formed in the lateral side wall has a recessed shape opening upward, and the air intake groove connects the air intake port having a recessed shape and formed in the medial side wall to the air intake port having a recessed shape and formed in the lateral side wall.

4. The shoe sole according to claim 3, wherein a bending groove recessed from the lower side in the thickness direction of the shoe sole is formed in the bottom surface part at a position facing the air intake groove formed in the upper surface part in the thickness direction of the shoe sole, and the bending groove extends from the lateral side wall to the medial side wall.

5. The shoe sole according to claim 4, wherein a deepest line passing through the bending groove is formed to be displaced rearward from a deepest line passing through the air intake groove.

6. A shoe comprising the shoe sole according to claim 1, wherein an inner sole, in which a plurality of small vent holes in communication with the ventilation grooves are formed, is mounted on the upper side of the shoe sole.

7. The shoe according to claim 6, wherein the plurality of small vent holes are formed in an area other than an area corresponding to the metatarsophalangeal joint.

8. The shoe according to claim 6, wherein the forefoot portion of the inner sole is provided with a cutout at an area corresponding to the at least one air intake port.

9. The shoe sole according to claim 1, wherein the at least one air intake port has a shape that spreads in a tapered shape toward the outside.

10. A shoe sole comprising: an upper surface part configured to enable an upper member to be provided thereover; a bottom surface part configured to be in contact with the ground; and a side wall part configured to connect an outer peripheral end of the upper surface part and an outer peripheral end of the bottom surface part in a thickness direction of the shoe sole, wherein ventilation grooves recessed in the thickness direction of the shoe sole are formed in the upper surface part, the shoe sole has a forefoot portion that has at least one air intake port formed in the side wall part to be in communication with the ventilation grooves and draw air from outside into the ventilation grooves, the shoe sole has a midfoot portion that has an air outlet port formed in at least one of the medial side wall on the medial side of the side wall part and the lateral side wall on the lateral side of the side wall part to be in communication with the air intake port through the ventilation grooves and discharge air in the ventilation grooves to the outside, a forward-most one of the at least one air intake port in a length direction of the shoe sole is located on a lateral side wall on a lateral side in the side wall part, a total opening area of the air outlet port is larger than a total opening area of the at least one air intake port, the air intake groove extends obliquely rearward from the lateral side of the shoe sole to the medial side, the air outlet port comprises at least one medial side air outlet port formed in the medial side wall and at least one lateral side air outlet port formed in the lateral side, a total opening area of the medial side outlet port is larger than a total opening area of the lateral side air outlet port, and the ventilation grooves each are formed to have a depth recessed in the thickness direction of the shoe sole gradually increasing as it advances from the front side of the forefoot portion toward the rear side of the midfoot portion.

11. The shoe sole according to claim 10, wherein the at least one medial side air outlet port is formed in an area between a first innermost point which is an innermost point in the forefoot portion of the shoe sole and a second innermost point which is an innermost point in the rearfoot portion of the shoe sole.

12. The shoe sole according to claim 10, wherein a total opening area of ends of the ventilation grooves opening on the medial side of the midfoot portion of the upper surface part is smaller than a total opening area of ends of the ventilation grooves opening on the lateral side of the midfoot portion of the upper surface part.

13. The shoe sole according to claim 10, wherein a part of the shoe sole is configured to be located on any straight line connecting an arbitrary point within the medial side air outlet port and an arbitrary point within the lateral side air outlet port.

14. The shoe sole according to claim 10, wherein a reinforcing member that suppresses distortion of an area around the medial side air outlet port is provided in at least a part of the area around the medial side air outlet port in the medial side wall.

15. A shoe comprising the shoe sole according to claim 10, wherein an inner sole, in which a plurality of small vent holes in communication with the ventilation grooves are formed, is mounted on the upper side of the shoe sole.

16. A shoe sole comprising: an upper surface part configured to enable an upper member to be provided thereover; a bottom surface part configured to be in contact with the ground; and a side wall part configured to connect an outer peripheral end of the upper surface part and an outer peripheral end of the bottom surface part in a thickness direction, wherein ventilation grooves recessed in the thickness direction of the shoe sole are formed in the upper surface part, the shoe sole has a forefoot portion that has at least one air intake port formed in the side wall part to be in communication with the ventilation grooves and draw air from outside into the ventilation grooves, an air outlet port is formed in an area between a first innermost point which is an innermost point in the forefoot portion of the shoe sole, and a second innermost point which is an innermost point in a rearfoot portion of the shoe sole, in a medial side wall on a medial side of the side wall part, to be in communication with the at least one air intake port and discharge air in the ventilation grooves to the outside, a forward-most one of the at least one air intake port in a length direction of the shoe sole is located on a lateral side wall on a lateral side in the side wall part, the air outlet port has an opening area larger than an opening area of the at least one air intake port of the forefoot portion, the air intake groove extends obliquely rearward from the air intake port on the lateral side of the shoe sole to the medial side, the air outlet port comprises at least one medial side air outlet port formed in the medial side wall and at least one lateral side air outlet port formed in the lateral side, a total opening area of the medial side outlet port is larger than a total opening area of the lateral side air outlet port, and the ventilation grooves each are formed to have a depth recessed in the thickness direction of the shoe sole gradually increasing as it advances from the front side of the forefoot portion toward the rear side of the midfoot portion.

* * * * *